US010959496B2

(12) United States Patent
Moeller

(10) Patent No.: US 10,959,496 B2
(45) Date of Patent: Mar. 30, 2021

(54) SLIDER ASSEMBLIES AND OUTDOOR EQUIPMENT INCLUDING THE SAME

(71) Applicant: Thomas A. Moeller, Reno, NV (US)

(72) Inventor: Thomas A. Moeller, Reno, NV (US)

( * ) Notice: Subject to any disclaimer, the term of this patent is extended or adjusted under 35 U.S.C. 154(b) by 0 days.

(21) Appl. No.: 16/573,173

(22) Filed: Sep. 17, 2019

(65) Prior Publication Data

US 2020/0093228 A1 Mar. 26, 2020

Related U.S. Application Data

(60) Provisional application No. 62/734,073, filed on Sep. 20, 2018.

(51) Int. Cl.

| | |
|---|---|
| ***A44B 19/30*** | (2006.01) |
| ***A45C 13/10*** | (2006.01) |
| ***A44B 19/40*** | (2006.01) |
| *A45F 3/04* | (2006.01) |

(52) U.S. Cl.

CPC ..... *A44B 19/303* (2013.01); *A44B 19/403* (2013.01); *A45C 13/103* (2013.01); *A45F 3/047* (2013.01)

(58) Field of Classification Search

CPC ... A44B 19/303; A44B 19/403; A45C 13/103; A45F 3/047; A45F 3/04

See application file for complete search history.

(56) References Cited

U.S. PATENT DOCUMENTS

| | | | | |
|---|---|---|---|---|
| 268,932 | A | 12/1882 | Poirier | |
| 2,580,477 | A * | 1/1952 | Statham | A41F 1/008 24/639 |
| 3,711,867 | A | 1/1973 | Mott | |
| 6,098,859 | A | 8/2000 | Bortner | |
| 6,808,099 | B2 | 10/2004 | Nykoluk | |
| 7,507,141 | B2 * | 3/2009 | Ward | A41F 15/002 2/69 |
| 7,681,769 | B2 | 3/2010 | Kramer | |
| 8,474,109 | B2 | 7/2013 | Takazawa et al. | |
| 9,326,586 | B2 * | 5/2016 | Kax | A45F 3/047 |
| 9,877,555 | B1 | 1/2018 | Tien | |
| 10,165,846 | B1 | 1/2019 | Gordon et al. | |
| 2007/0152007 | A1 | 7/2007 | Kauss et al. | |
| 2013/0320053 | A1 | 12/2013 | Kim | |

(Continued)

*Primary Examiner* — Robert Sandy

*Assistant Examiner* — Rowland Do

(74) *Attorney, Agent, or Firm* — Dascenzo Gates Intellectual Property Law, P.C.

(57) ABSTRACT

Slider assemblies and outdoor equipment including the same. A slider assembly is configured to be slidingly coupled to a slide track and includes a slider body and an actuation lever operatively coupled to the slider body. The slider body includes a first clamp member and a second clamp member that collectively define at least a portion of a track receiver. The slider assembly is configured to selectively translate along the slide track and includes a lock mechanism configured to selectively prevent the slider assembly from translating relative to the slide track. The actuation lever selectively transitions the slider assembly between an adjustment configuration and a locked configuration. When the slider assembly transitions from the adjustment configuration toward the locked configuration, one or both of the first clamp member and the second clamp member move toward one another.

20 Claims, 14 Drawing Sheets

(56) References Cited

U.S. PATENT DOCUMENTS

| | | | |
|---|---|---|---|
| 2014/0263498 | A1 | 9/2014 | Flem et al. |
| 2015/0033446 | A1 | 2/2015 | Kanayama |
| 2017/0007009 | A1 | 1/2017 | Guthrie et al. |

* cited by examiner

SLIDER ASSEMBLIES AND OUTDOOR EQUIPMENT INCLUDING THE SAME

RELATED APPLICATION

This application claims priority under 35 U.S.C. § 119(e) to U.S. Provisional Patent Application Ser. No. 62/734,073, which was filed on Sep. 20, 2018, the complete disclosure of which is hereby incorporated by reference.

FIELD

The present disclosure relates to slider assemblies and outdoor equipment including the same.

BACKGROUND

Fastener systems, such as buckle-type fastening mechanisms, may be used in a variety of applications, including outdoor equipment, backpacks, luggage, clothing, home furnishings, automotive equipment, and/or other accessories. In some examples, fastener systems include male and female closures to interlock and secure components together. For example, some prior art fastening systems include a female component and a male component that interlock with one another, with each of the female component and the male component including a sliding clip that moves along a track. However, due to inconsistencies between manufacturing processes and poor locking features, many prior art sliding fasteners may pop off and become disconnected from the track during use and may be difficult to reconnect. For example, many fastener systems include piping tracks that are formed via an extrusion process that generally includes a variable degree of shrinking or warping. In such examples, it may be difficult to ensure that the piping track is dimensioned such that the sliding fastener remains slidingly coupled to the piping track. Further, many such piping tracks are in the form of a tube that includes a plastic extrusion covered with a fabric covering on which the sliding fastener slides. However, the covering or wrapping operations that are required to position the fabric covering over the plastic extrusion can be expensive.

SUMMARY

Slider assemblies and outdoor equipment including the same are disclosed herein. A slider assembly is configured to be operatively and slidingly coupled to a slide track and includes a slider body and an actuation lever operatively coupled to the slider body. The slider body includes a first clamp member and a second clamp member that collectively define at least a portion of a track receiver that receives a portion of the slide track when the slider assembly is operatively coupled to the slide track. The slider assembly is configured to selectively translate along the slide track when the slider assembly is operatively coupled to the slide track, and includes a lock mechanism configured to selectively prevent the slider assembly from translating relative to the slide track. The actuation lever is configured to pivot about a lever pivot axis and relative to the slider body to selectively transition the slider assembly between an adjustment configuration and a locked configuration. When the slider assembly is in the adjustment configuration, the slider assembly may be selectively and operatively translated along the slide track when the slider assembly is operatively coupled to the slide track. When the slider assembly is in the locked configuration, the lock mechanism prevents the slider assembly from translating relative to the slide track when the slider assembly is operatively coupled to the slide track. When the slider assembly transitions from the adjustment configuration toward the locked configuration, one or both of the first clamp member and the second clamp member move toward one another.

DETAILED DESCRIPTION

FIGS. 1-28 provide examples of slider assemblies 100 according to the present disclosure. Elements that serve a similar, or at least substantially similar, purpose are labeled with like numbers in each of FIGS. 1-28, and these elements may not be discussed in detail herein with reference to each of FIGS. 1-28. Similarly, all elements may not be labeled in each of FIGS. 1-28, but reference numbers associated therewith may be utilized herein for consistency. Elements, components, and/or features that are discussed herein with reference to one or more of FIGS. 1-28 may be included in and/or utilized with any of FIGS. 1-28 without departing from the scope of the present disclosure.

Figure 1:
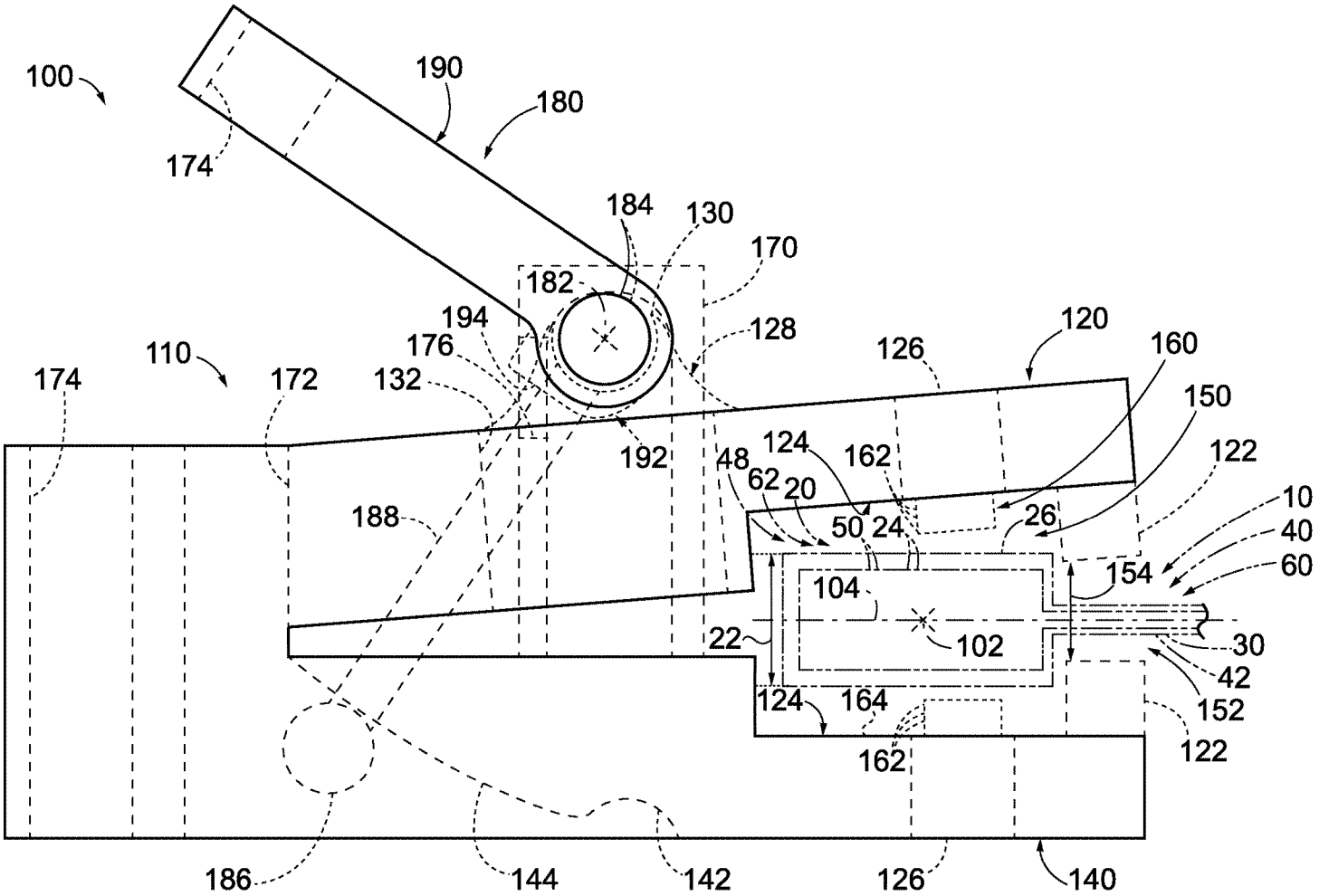
FIG. 1 is a schematic side elevation view representing examples of slider assemblies in an adjustment configuration according to the present disclosure.
Figure 2:
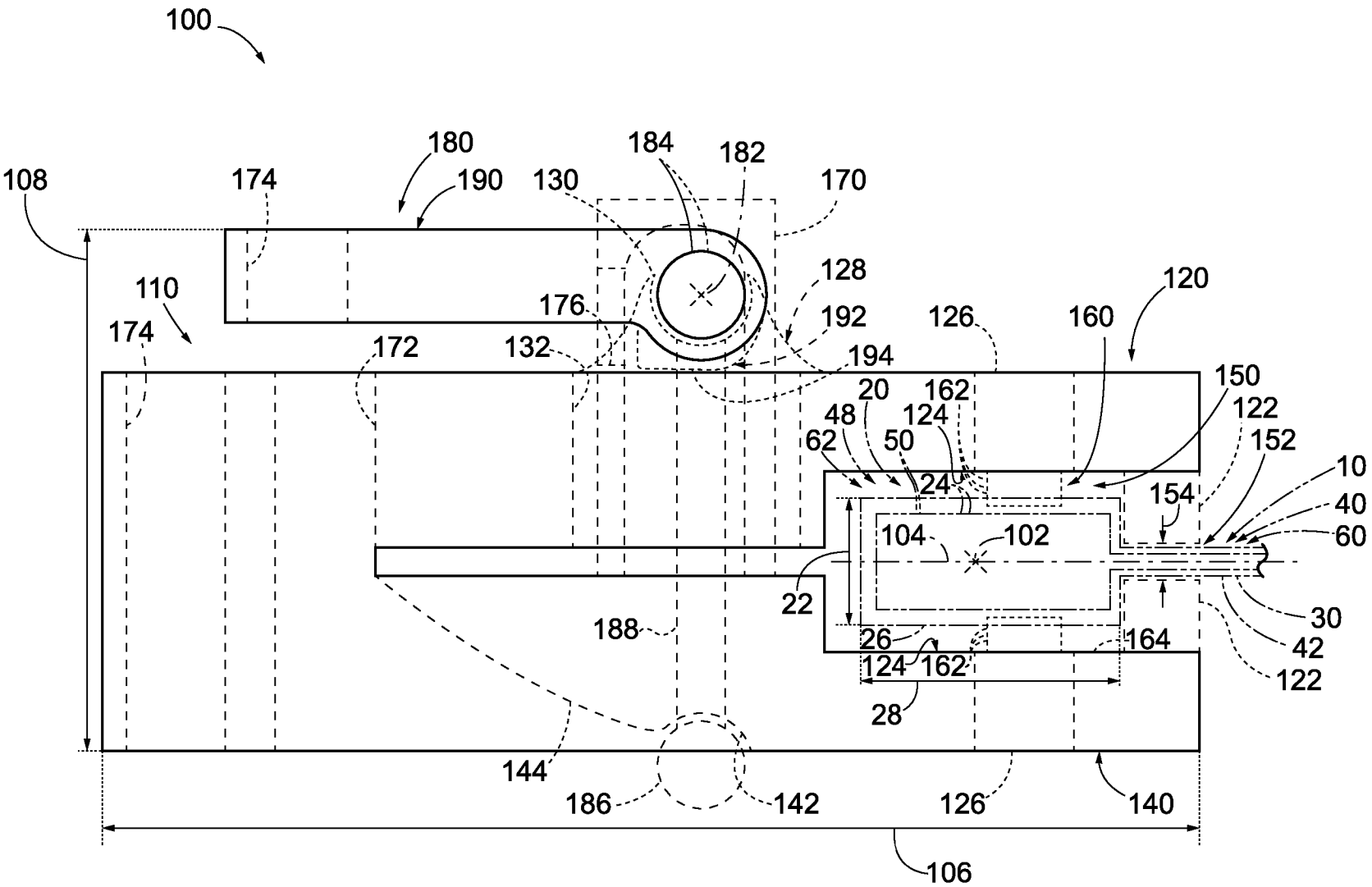
FIG. 2 is a schematic side elevation view representing examples of slider assemblies in a locked configuration according to the present disclosure.
Figure 3:
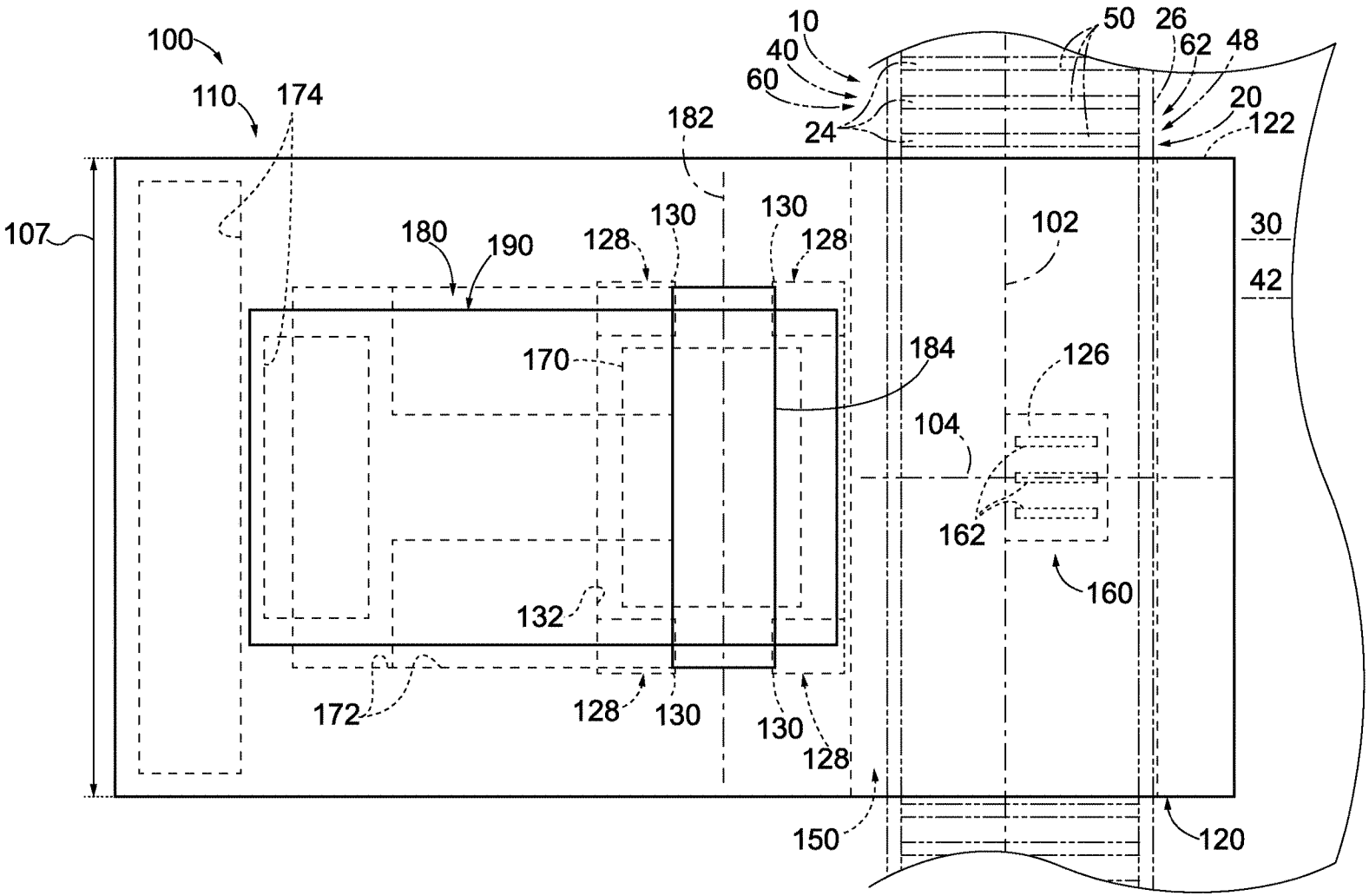
FIG. 3 is a schematic top plan view representing examples of slider assemblies in a locked configuration according to the present disclosure.
Figure 4:
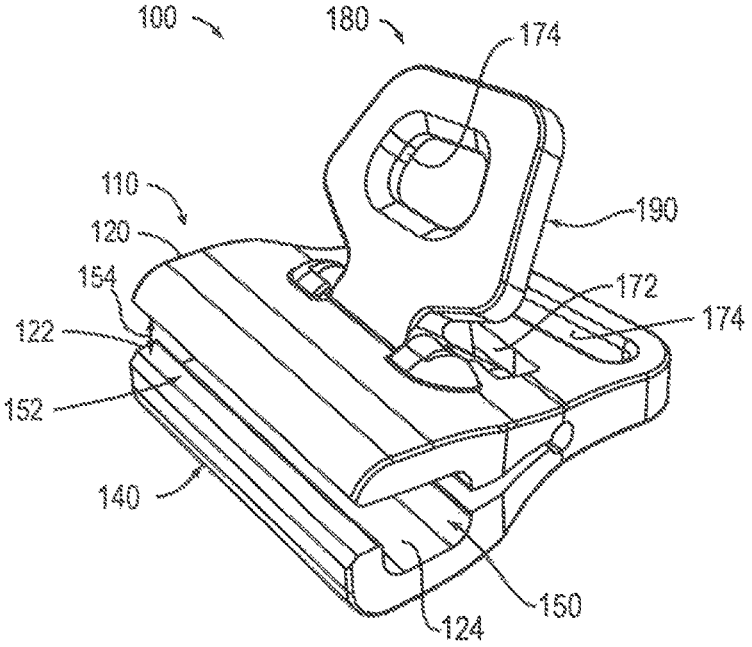
FIG. 4 is a top front side isometric view representing an example of a slider assembly in an adjustment configuration according to the present disclosure.

In general, in FIGS. 1-3, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

FIGS. 1-3 are schematic illustrations of examples of slider assemblies 100, such as may be operatively coupled to and utilized in conjunction with a slide track 10. Specifically, FIGS. 1-2 are schematic side elevation views representing examples of slider assemblies 100, while FIG. 3 is a schematic top plan view representing additional examples and/or aspects of slider assemblies 100. As schematically illustrated in FIGS. 1-3, a slider assembly 100 includes a slider body 110 and an actuation lever 180 operatively coupled to the slider body. Slider body 110 includes a first clamp member 120 and a second clamp member 140, each of which at least partially defines a track receiver 150. Stated differently, and as schematically illustrated in FIGS. 1-2, first clamp member 120 and second clamp member 140 collectively define at least a portion of track receiver 150. As described in more detail herein, actuation lever 180 generally is configured to be selectively actuated by a user to selectively vary a size of track receiver 150, such as to selectively engage and/or increase a degree of engagement with slide track 10 within the track receiver.

Slider assembly 100, slider body 110, and/or actuation lever 180 may be formed in any appropriate manner and/or may have any appropriate material construction. As examples, each of slider body 110 and/or actuation lever 180 may be formed of a plastic, a thermoplastic, and/or a metal, and/or may be formed via an injection molding process. In some examples, first clamp member 120 and second clamp member 140 may be integrally formed with one another. Additionally or alternatively, slider assembly 100 may be configured such that first clamp member 120 and second clamp member 140 are biased away from one another in at least some situations during operative use of the slider assembly. In some examples, and as described in more detail herein, actuation lever 180 is configured to be selectively and repeatedly removed from and operatively coupled to slider body 180 without damage to slider assembly 100.

Actuation lever 180 may be operatively coupled to slider body 110 in any appropriate manner. For example, and as schematically illustrated in FIGS. 1-3, slider body 110 may include a pivot member receiver 128, and actuation lever 180 may include at least one pivot member 184 that is pivotally received within the pivot member receiver. As more specific examples, and as schematically illustrated in FIGS. 1-3, each pivot member 184 may be a unitary bar (such as a cylindrical bar) or may be one of a plurality of spaced-apart protrusions (such as cylindrical protrusions). In such examples, and as further schematically illustrated in FIGS. 1-3, pivot member receiver 128 may include a pivot member retainer 130 that is configured to retain pivot member 184 within pivot member receiver 128. In some examples, and as described in more detail herein, actuation lever 180 is configured to be selectively and repeatedly removed from and coupled to slider body 110. In such examples, pivot member retainer 130 further may be configured to permit pivot member 184 to be selectively removed from pivot member receiver 128. As examples, pivot member retainer 130 may be configured to receive pivot member 184 in a snap-fit and/or friction-fit arrangement that is configured to facilitate selective removal of the pivot member from the pivot member retainer.

As schematically illustrated in FIGS. 1-3, slider assembly 100 is configured such that track receiver 150 receives a portion of a slide track 10 during operative use of the slider assembly. More specifically, and as schematically illustrated in FIGS. 1-3, track receiver 150 may extend along a receiver axis 102, and slider assembly 100 may be configured to selectively translate along slide track 10 in a direction parallel to the receiver axis during operative use of the slider assembly. Additionally, and as discussed in more detail herein, slider assembly 100 also is configured to be selectively prevented from translating along the slide track when the slider assembly is operatively coupled to the slide track. More specifically, and as schematically illustrated in FIGS. 1-3, slider body 110 includes a lock mechanism 160 configured to selectively prevent slider assembly 100 from translating relative to slide track 10. In this manner, slider assemblies 100 according to the present disclosure generally are configured to be selectively positioned along the length of slide track 10 and to be selectively locked in position relative to the slide track.

As used herein, the term "restrict," as used to describe a mechanism or action in opposition to a process or outcome, is intended to indicate that the mechanism or action operates to at least substantially, and optionally fully, diminish, block, and/or preclude the process or outcome from proceeding and/or being completed. As examples, the use of the term "restrict," such as in describing a mechanism as restricting translation of slider assembly 100 relative to slide track 10, is intended to indicate that the mechanism selectively prevents, impedes, blocks, obstructs, and/or otherwise substantially limits an ability to operatively translate the slider assembly along the slide track without damage to either of the slider assembly or the slide track.

As used herein, the term "prevent," as used to describe a mechanism or action in opposition to a process or outcome, is intended to indicate that the mechanism or action operates to fully block and/or preclude the process or outcome from proceeding and/or being completed during operative use of the structures and components according to the present disclosure. Stated differently, as used herein, the term "prevent" is not intended to indicate that the mechanism or action will fully block and/or preclude the process or outcome from proceeding and/or being completed in all possible uses, but rather is intended to indicate that the process or outcome is prevented at least when the structures and components disclosed herein are utilized in a manner consistent with the present disclosure.

As used herein, slider assembly 100 may be described as being "in operative use" and/or as being "operatively utilized" when the slider assembly is operatively coupled to slide track 10 when at least a portion of the slide track extends within track receiver 150. In this manner, references within the present disclosure to slider assembly 100 (and/or a component thereof) in conjunction with slide track 10 (and/or a component thereof) are intended to refer to a configuration in which the slider assembly is operatively coupled to the slide track, as described herein. However, while the present disclosure generally describes examples in which components of slide track 10 extend within and/or interact with components of slider assembly 100, such examples are not intended to be limiting, and it is within the scope of the present disclosure that slider assembly 100 is not always operatively coupled to and/or operatively utilized in conjunction with slide track 10.

Slider assemblies 100 according to the present disclosure generally are configured to facilitate selectively positioning an accessory that is operatively coupled to the slider assembly relative to slide track 10. For example, and as schematically illustrated in FIGS. 1-3, slider assembly 100 additionally may include one or more attachment points 174 configured to enable the slider assembly to be operatively attached to an accessory. Attachment point 174 may include and/or be any appropriate component and/or structure, examples of which include a hole, a slot, an aperture, a channel, a groove, a buckle, a ladder-lock buckle, and/or a component of a side-release buckle. In this manner, attachment point 174 may be configured to receive and/or be operatively coupled to any appropriate accessory, examples of which include a strap, a webbing, a cord, an elastic cord, a non-elastic cord, a buckle, and/or a component of a side-release buckle. As schematically illustrated in FIGS. 1-3, one or both of slider body 110 and actuation lever 180 may include a respective attachment point 174. While FIGS. 1-3 schematically illustrate attachment point 174 as an aperture extending through slider body 110 and/or actuation lever 180 along a direction perpendicular to receiver axis 102, this is not required of all examples of slider assembly 100. For example, it is additionally within the scope of the present disclosure that attachment point 174 may be an aperture extending through slider body 110 and/or actuation lever 180 along a direction at least substantially parallel to receiver axis 102.

As schematically illustrated in FIGS. 1-3, actuation lever 180 is configured to pivot relative to slider body 110 about a lever pivot axis 182 to selectively permit or prevent slider assembly 100 from translating relative to slide track 10. More specifically, actuation lever 180 is configured to pivot relative to slider body 110 to transition slider assembly 100 between an adjustment configuration (schematically illustrated in FIG. 1), in which the slider assembly may be selectively and operatively translated along slide track 10 along a direction parallel to receiver axis 102, and a locked configuration (schematically illustrated in FIG. 2), in which the lock mechanism prevents the slider assembly from translating relative to the slide track. As schematically illustrated in FIG. 2, lock mechanism 160 (e.g., the structures and/or portions of first clamp member 120 and/or second clamp member 140 that are configured to engage slide track 10) generally is spaced apart from actuation lever 180 when slider assembly 100 is in the locked configuration. Similarly, and as additionally schematically illustrated in FIG. 2, actuation lever 180 generally is spaced apart from slide track 10 when slider assembly 100 is in the locked configuration and operatively coupled to the slide track.

Actuation lever 180 also may be described as being configured to pivot relative to slider body 110 such that the actuation lever assumes a plurality of positions defined between and including an adjusting position (schematically illustrated in FIG. 1) and a locking position (schematically illustrated in FIG. 2). In this manner, slider assembly 100 may be in the adjustment configuration when actuation lever 180 is in the adjusting position, and the slider assembly may be in the locked configuration when the actuation lever is in the locking position. While the position of actuation lever 180 generally is determinative of the configuration of slider assembly 100 during operative use of the slider assembly, it is additionally within the scope of the present disclosure that the slider assembly may be in the adjustment configuration even when the actuation lever is not in the adjusting position, and/or that the slider assembly may be in the locking position even when the actuation lever is not in the locking position. As schematically illustrated in FIGS. 1-3, lever pivot axis 182 may be at least substantially parallel to receiver axis 102. However, this is not required of all examples of slider assembly 100, and it is additionally within the scope of the present disclosure that lever pivot axis 182 have an orientation that is nonparallel to receiver axis 102, oblique to the receiver axis, and/or perpendicular to the receiver axis.

Actuation lever 180 may operate to transition slider assembly 100 between the adjustment configuration and the locked configuration in any appropriate manner. For example, and as schematically illustrated in FIGS. 1-3, actuation lever 180 may include an engagement element 190 that is configured to be selectively engaged by a user to selectively pivot the actuation lever relative to slider body 110 and about lever pivot axis 182. In some examples, and as described in more detail herein, slider assembly 100 transitioning from the adjustment configuration toward the locked configuration includes and/or corresponds to first clamp member 120 and/or second clamp member 140 moving toward one another, such that actuation lever 180 operates to urge the first clamp member and the second clamp member together. As used herein, a reference to first clamp member 120 moving toward second clamp member 140 equivalently may be described as the second clamp member moving toward the first clamp member. That is, as used herein, a reference to a motion of either of the first clamp member and the second clamp member relative to the other is intended to encompass any appropriate motion (or lack thereof) of the first clamp member and/or of the second clamp member, in absolute terms and/or relative to another component of slider assembly 100, that produces the described relative motion between the first clamp member and the second clamp member and/or the described expanding or contracting of track receiver 150.

Track receiver 150 may have any appropriate form and/or structure for operatively receiving slide track 10. For example, and as schematically illustrated in FIGS. 1-2, first clamp member 120 and second clamp member 140 collectively may define a receiver opening 152 configured to permit access to track receiver 150 along a direction parallel to a lateral axis 104 that extends perpendicular to receiver axis 102. In this manner, and as schematically illustrated in FIGS. 1-2, receiver opening 152 may be described as extending adjacent to track receiver 150.

Slider assembly 100 may have any appropriate dimensions, such as may be configured to facilitate operative engagement with slide track 10 without being overly bulky. In this manner, a size and/or dimension of a given example of slider assembly 100 may be specifically selected and/or configured for the intended application of the given slider assembly. As examples, and as schematically illustrated in FIG. 2, slider assembly 100 may have a slider assembly length 106, as measured along a direction parallel to lateral axis 104, that is at least 10 millimeters (mm), at least 15 mm, at least 20 mm, at least 25 mm, at least 30 mm, at least 40 mm, at most 50 mm, at most 35 mm, at most 27 mm, at most 22 mm, at most 17 mm, and/or at most 12 mm. As additional examples, and as schematically illustrated in FIG. 3, slider assembly 100 may have a slider assembly width 107, as measured along a direction parallel to receiver axis 102, that is least 10 mm, at least 15 mm, at least 20 mm, at least 25 mm, at least 30 mm, at least 40 mm, at most 50 mm, at most 35 mm, at most 27 mm, at most 22 mm, at most 17 mm, and/or at most 12 mm. As further examples, and as schematically illustrated in FIG. 2, slider assembly 100 may have a slider assembly depth 108, as measured along a direction perpendicular to each of receiver axis 102 and lateral axis 104 when the slider assembly is in the locked configuration, that is at least 5 mm, at least 10 mm, at least 15 mm, at least 20 mm, at most 25 mm, at most 17 mm, at most 12 mm, and/or at most 7 mm.

In some examples, and as schematically illustrated in FIGS. 1-3, slider assembly 100 is configured to be operatively utilized in conjunction with a slide track 10 that includes a retention portion 20 that extends within track receiver 150 and a connection portion 30 that extends away from the retention portion and through receiver opening 152. In such examples, track receiver 150 generally is configured to selectively receive retention portion 20 such that lock mechanism 160 selectively retains the retention portion within the track receiver, such as to selectively prevent the retention portion from being removed from the track receiver along lateral axis 104 and to selectively restrict and/or prevent the retention portion from translating relative to the track receiver along receiver axis 102. For example, and as schematically illustrated in FIGS. 1-2, retention portion 20 may be described as having a retention portion thickness 22, as measured along a direction perpendicular to each of receiver axis 102 and lateral axis 104, and receiver opening 152 may be described as having an opening width 154, as measured along the direction perpendicular to each of the receive axis and the lateral axis, that is smaller than the retention portion thickness when slider assembly 100 is in either of the locked configuration or the adjustment configuration. In some examples, and as further schematically illustrated in FIGS. 1-3, slide track 10 additionally may include a fabric covering 26 that at least substantially covers retention portion 20, and lock mechanism 160 may be configured to engage the fabric covering when slider assembly 100 is in the adjustment configuration (as schematically illustrated in FIG. 1) and/or in the locked configuration (as schematically illustrated in FIG. 2). Additionally or alternatively, and as further schematically illustrated in FIGS. 1-3, retention portion 20 may include and/or consist of a plurality of discrete track elements 24 that are distributed along a length of the retention portion. In such examples, lock mechanism 160 may be configured to selectively engage one or more track elements 24 such that slide track 10 is prevented from moving relative to slider assembly 100 (or vice versa) along a direction parallel to receiver axis 102 when the slider assembly is in the locked configuration.

Slider assembly 100 may be configured to be operatively utilized in conjunction with slide track 10 that has any appropriate dimensions. As examples, and as schematically illustrated in FIG. 2, retention portion 20 may have a retention portion length 28, as measured along a direction parallel to lateral axis 104 when slider assembly 100 is operatively coupled to slide track 10, that is at least 2 mm, at least 4 mm, at least 6 mm, at least 8 mm, at least 10 mm, at most 15 mm, at most 9 mm, at most 7 mm, at most 5 mm, and/or at most 3 mm.

Slider body 110 and/or track receiver 150 may have any appropriate form and/or structure to configure opening width 154 to be smaller than retention portion thickness 22. For example, and as best schematically illustrated in FIGS. 1-2, first clamp member 120 and/or second clamp member 140 may include a lip 122 that extends toward the other of the first clamp member and the second clamp member, such as in a direction at least substantially perpendicular to receiver axis 102 and/or lateral axis 104. That is, first clamp member 120 may include lip 122 extending toward second clamp member 140, and/or second clamp member 140 may include lip 122 extending toward first clamp member 120. In such examples, each lip 122 may at least partially define track receiver 150 and/or receiver opening 152. In this manner, lip 122 may operate to restrict and/or prevent slide track 10 from being removed from track receiver 150 along a direction parallel to lateral axis 104, such as by configuring opening width 154 to be smaller than retention portion thickness 22.

Slider body 110, first clamp member 120, second clamp member 140, and/or each lip 122 may be configured such that track receiver 150 has any appropriate cross-sectional shape. As examples, track receiver 150 may have a cross-sectional shape, as viewed along receiver axis 102, that generally is at least substantially polygonal, at least substantially rectangular, at least substantially circular, and/or non-circular. In some examples, and as discussed herein, the cross-sectional shape of track receiver 150 generally may at least substantially correspond to a cross-sectional shape of retention portion 20 of slide track 10 with which slider assembly 100 is configured to be utilized.

Slide track 10, retention portion 20, and/or connection portion 30 may include and/or be any appropriate structures. As an example, and as schematically illustrated in FIGS. 1-3, slide track 10 may include and/or be a zipper tape 40. In such examples, retention portion 20 may include and/or be a zipper chain 48 that is defined by a plurality of zipper elements 50, such that each zipper element represents an example of track element 24. In such examples, and as additionally schematically illustrated in FIGS. 1-3, zipper tape 40 may include a zipper support 42 such that connection portion 30 includes and/or is the zipper support and such that each of the plurality of zipper elements 50 is operatively coupled to the zipper support. As another example, and as further schematically illustrated in FIGS. 1-3, slide track 10 may include and/or be a slide piping 60 in which retention portion 20 includes and/or is an elongate rod 62. In such examples, elongate rod 62 may have any appropriate form and/or shape, such as a cross-sectional shape that is at least substantially circular. Slide track 10, retention portion 20, and/or elongate rod 62 may be formed via any appropriate manufacturing process, such as an extrusion process and/or an injection molding process. In such examples, retention portion 20 may be formed to have a cross-sectional shape that at least substantially corresponds to and/or matches the cross-sectional shape of track receiver 150.

As described herein, slider assembly 100 generally is configured to selectively prevent retention portion 20 from being removed from track receiver 150 along a direction parallel to lateral axis 104 (or, equivalently, to selectively prevent the slider assembly from being removed from slide track 10 along the direction parallel to the lateral axis) when the slider assembly is in either of the locked configuration or the adjustment configuration. In some examples, slider assembly 100 further may be configured to be selectively transitioned to a removal configuration, in which retention portion 20 may be selectively removed from track receiver 150 along a direction parallel to lateral axis 104. In such examples, opening width 154 may be substantially equal to or greater than retention portion thickness 22 when slider assembly 100 is in the removal configuration.

Slider assembly 100 may be configured to transition to the removal configuration in any appropriate manner, such as via rotation and/or removal of actuation lever 180 from slider body 110. For example, and as discussed, actuation lever 180 may be configured to be selectively and repeatedly removed from and coupled to slider body 110. In such examples, slider assembly 100 may be configured to be selectively transitioned to the removal configuration only when actuation lever 180 is selectively removed from slider body 110, such as to permit first clamp member 120 and second clamp member 140 to spread apart further than would be possible when the actuation lever is operatively coupled to the slider body. In other examples, actuation lever 180 may be configured to pivot about lever pivot axis 182 while the actuation lever is operatively coupled to slider body 110 to enable slider assembly 100 to transition to the removal configuration. In such examples, actuation lever 180 may be configured to selectively assume a removing position (e.g., relative to slider body 110) such that the slider assembly is in the removal configuration when the actuation lever is in the removing position. In such examples, slider assembly 100 may be configured to be transitioned to the removal configuration only subsequent to transitioning actuation lever 180 to the removing position. Additionally or alternatively, actuation lever 180 may be configured to transition between the locking position and the removing position via the adjusting position, or may be configured to transition between the adjusting position and the removing position via the locking position.

Actuation lever 180 may operate to urge first clamp member 120 and second clamp member 140 toward one another in any appropriate manner. For example, actuation lever 180 may be configured to engage one or both of first clamp member 120 and second clamp member 140 to move the first clamp member and the second clamp member toward one another as the actuation lever pivots to transition slider assembly 100 from the adjustment configuration to the locked configuration. In some examples, and as schematically illustrated in FIGS. 1-2 and described in more detail herein, actuation lever 180 extends at least partially through slider body 180, such as at least partially through each of first clamp member 120 and second clamp member 140. However, this is not required of all examples of slider assembly 100, and it is additionally within the scope of the present disclosure that actuation lever 180 extends at least substantially exterior of slider body 110.

Figure 5:
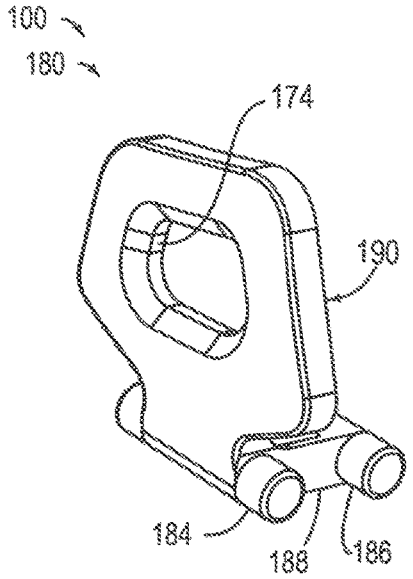
FIG. 5 is a top front side isometric view representing an actuation lever of the slider assembly of FIG. 4.
Figure 6:
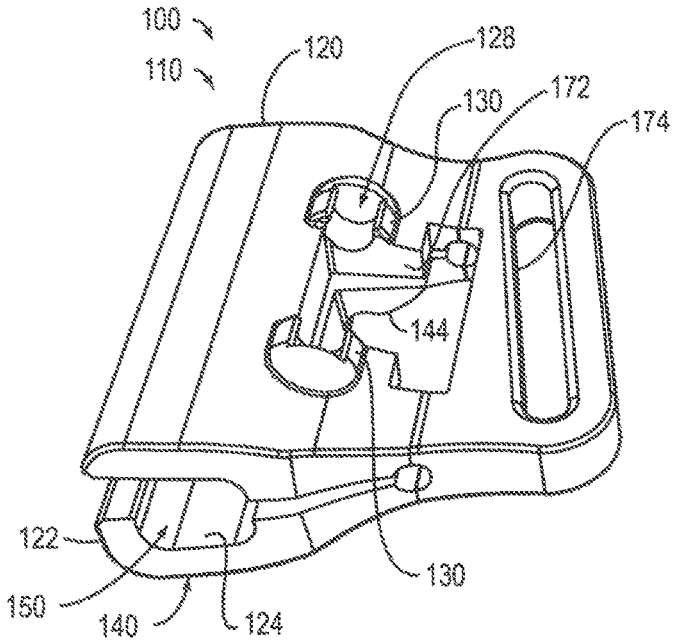
FIG. 6 is a top side isometric view representing a slider body of the slider assembly of FIGS. 4-5.
Figure 7:
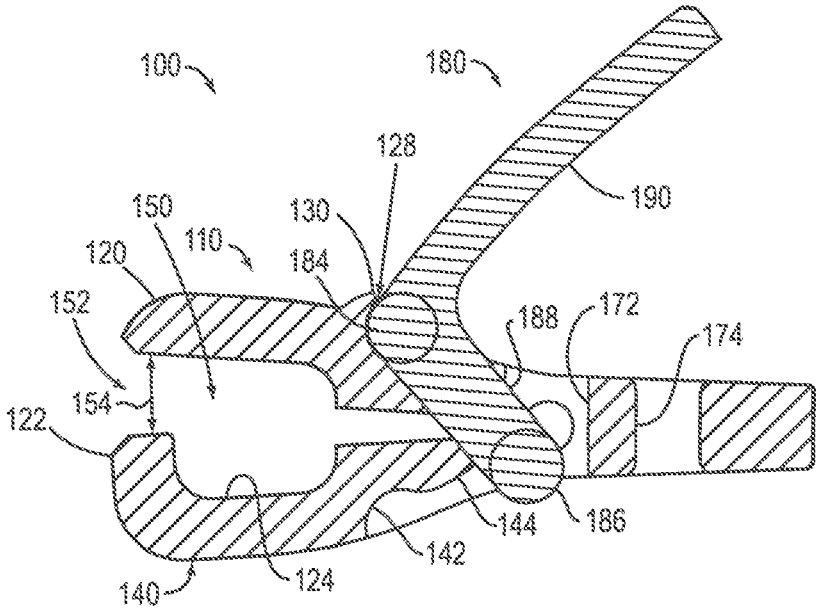
FIG. 7 is a cross-sectional side elevation view representing an example of a slider assembly in an adjustment configuration according to the present disclosure.
Figure 8:
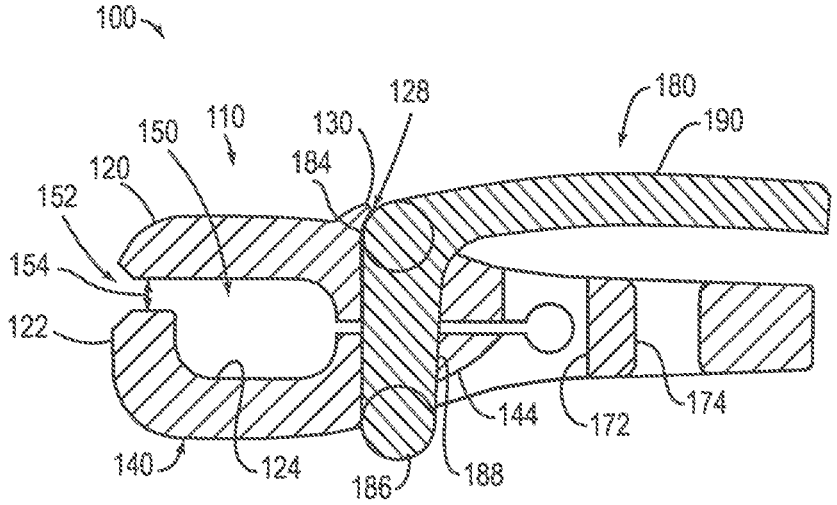
FIG. 8 is a cross-sectional side elevation view representing the slider assembly of FIG. 7 in a locked configuration according to the present disclosure.

In some examples, actuation lever 180 is configured to engage each of first clamp member 120 and second clamp member 140 to transition slider assembly 100 from the adjustment configuration to the locking configuration. For example, and as schematically illustrated in FIGS. 1-2, actuation lever 180 may include a lever lock 186 (such as may take the form of a unitary and/or cylindrical bar), first clamp member 120 may include pivot member receiver 128, and second clamp member 140 may include a lever lock receiver 142 that receives the lever lock when slider assembly 100 is in the locked configuration. FIGS. 4-8 are less schematic representations of an example of slider assembly 100 in which actuation lever 180 includes lever lock 186 (as shown in FIGS. 5 and 7-8) and in which first clamp member 120 includes pivot member receiver 128 (as shown in FIGS. 6-8). However, such a configuration is not necessary, and it is additionally within the scope of the present disclosure that second clamp member 140 includes pivot member receiver 128 and first clamp member 120 includes lever lock receiver 142.

As schematically illustrated in FIGS. 1-2, and as less schematically illustrated in FIGS. 5 and 7-8, actuation lever 180 further may include a connector element 188 that extends between pivot member 184 and lever lock 186. In such examples, connector element 188 may be statically coupled to engagement element 190, for example such that the connector element and the engagement element extend in a fixed orientation relative to one another. In such examples, connector element 188 and engagement element 190 may be directly coupled to one another, or may be operatively coupled to one another via pivot member 184. Additionally or alternatively, connector element 188 and engagement element 190 may be monolithic and/or integrally formed, such that the connector element and the engagement element correspond to respective portions and/or regions of a single unit. As schematically illustrated in FIGS. 1-2 and less schematically illustrated in FIGS. 5 and 7-8, connector element 188 and engagement element 190 may be nonparallel with one another and/or may extend at least substantially perpendicular to one another, for example such that the engagement element extends at least substantially parallel to slider body 110 when slider assembly 100 is in the locked configuration (as shown in FIGS. 2 and 8).

Lever lock 186, when present, may engage and/or interact with lever lock receiver 142 in any appropriate manner for selectively retaining slider assembly 100 in the locked configuration. For example, when pivot member 184 is operatively received within pivot member receiver 128, pivoting actuation lever 180 to transition slider assembly 100 from the adjustment configuration to the locked configuration may operate to move lever lock 186 into lever lock receiver 142, and pivoting the actuation lever to transition the slider assembly from the locked configuration to the adjustment configuration may operate to move the lever lock out of the lever lock receiver.

In some examples, lever lock 186 is restricted from exiting lever lock receiver 142 when slider assembly 100 is in the locked configuration, thus operating to restrict the slider assembly from transitioning away from the locked configuration. In such examples, slider assembly 100 may be configured to transition from the locked configuration toward the adjustment configuration responsive to a user applying a torque to engagement element 190 that is equal to or greater than a threshold torque (e.g., the torque necessary to move lever lock 186 out of lever lock receiver 142). Additionally or alternatively, and as further schematically illustrated in FIGS. 1-2 and less schematically illustrated in FIGS. 6-8, the clamp member (i.e., first clamp member 120 or second clamp member 140) that includes lever lock receiver 142 additionally may include a lever lock ramped surface 144 such that lever lock 186 translates along the lever lock ramped surface as slider assembly 100 transitions between the adjustment configuration and the locked configuration. In such examples, as the slider assembly is transitioned from the adjustment configuration toward the locked configuration, engagement between lever lock 186 and lever lock ramped surface 144 operates to urge first clamp member 120 and second clamp member 140 toward one another.

As discussed, slider assembly 100 may be configured such that actuation lever 180 may be selectively and repeatedly removed from and coupled to slider body 110. In such examples, and when actuation lever 180 includes lever lock 186 and as schematically illustrated in FIGS. 1-3, slider body 110 may include and/or define a lever lock aperture 172 that is sized, oriented, and/or otherwise configured to permit one or both of the lever lock and connector element 188 (shown in FIGS. 1-2) to be selectively inserted into and removed from the slider body. In such examples, slider assembly 100 may be configured to be assembled by inserting lever lock 186 through lever lock aperture 172 and subsequently receiving pivot member 184 within pivot member receiver 128 to operatively couple actuation lever 180 to slider body 110. It is additionally within the scope of the present disclosure that slider body 110 may include lever lock aperture 172 even if actuation lever 180 is not configured to be selectively and repeatedly removed from and coupled to slider body 110.

Figure 9:
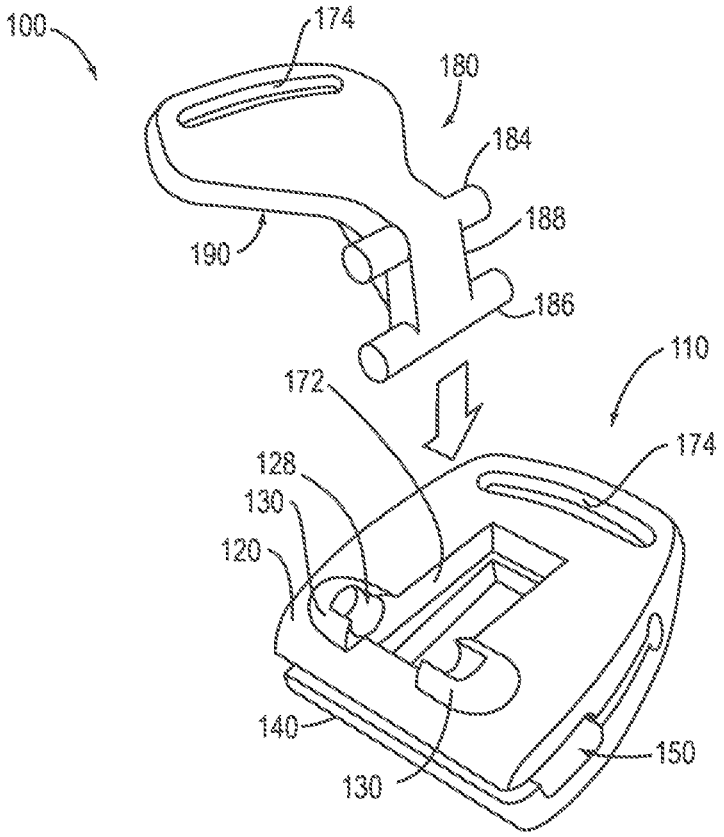
FIG. 9 is a top front side isometric view representing an example step of assembling a slider assembly according to the present disclosure.
Figure 10:
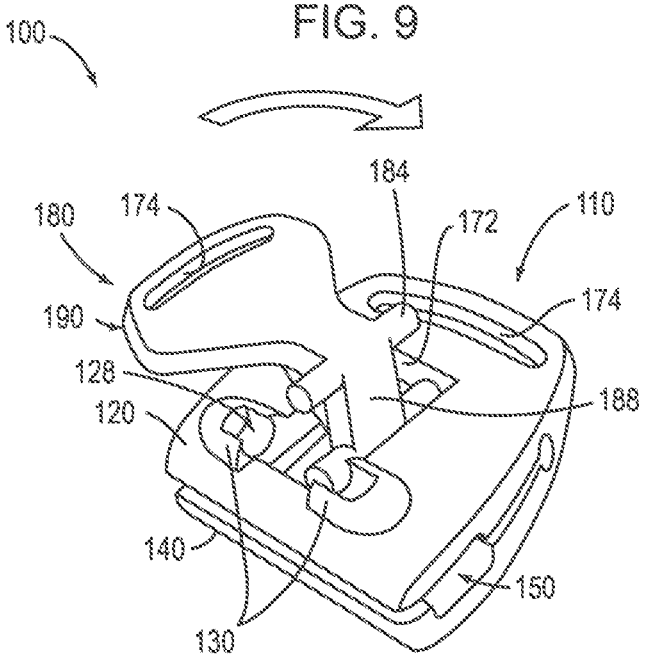
FIG. 10 is a top front side isometric view representing a further example step, according to the present disclosure, of assembling the slider assembly of FIG. 9.

Lever lock aperture 172 may have any appropriate shape and/or form for selectively receiving lever lock 186. For example, and as schematically illustrated in FIG. 3, lever lock aperture 172 may include and/or be an elongate aperture that is elongate along a direction at least substantially parallel to lever pivot axis 182. Additionally or alternatively, lever lock aperture 172 may include and/or be an elongate aperture that is elongate along a direction at least substantially parallel to lateral axis 104. In such examples, slider assembly 100 may be configured to be assembled by inserting lever lock 186 through lever lock aperture 172 and subsequently rotating the lever lock relative to slider body 110, such as to align pivot member 184 with pivot member receiver 128. FIGS. 9-10 provide less schematic illustrations of such a configuration. Specifically, FIG. 9 illustrates an example of slider assembly 100 in which actuation lever 180 is removed from slider body 110 and is positioned with lever lock 186 substantially aligned with elongate lever lock aperture 172 such that the actuation lever may be inserted into the slider body. FIG. 10 illustrates the slider assembly 100 of FIG. 9 subsequent to inserting the actuation lever into the slider body, such that rotating the actuation lever relative to the slider body will align pivot member 184 with pivot member receiver 128 such that the actuation lever may be operatively coupled to the slider body.

In other examples, and as schematically illustrated in FIGS. 1-2, actuation lever 180 includes a cam surface 192 that is configured to urge first clamp member 120 and second clamp member 140 toward one another as the actuation lever is pivoted from the adjustment configuration toward the locked configuration. In such examples, actuation lever 180 may not include lever lock 186 or connector element 188 and/or may not extend through slider body 110. Additionally, in such examples, and as schematically illustrated in FIGS. 1-3, slider body 110 may include a lever lug 170 that includes and/or defines pivot member receiver 128 (shown in FIGS. 1-2). More specifically, when present, lever lug 170 may be statically coupled to one of first clamp member 120 and second clamp member 140 and may be configured to move relative to the other of the first clamp member and the second clamp member as slider assembly 100 transitions between the adjustment configuration and the locked configuration. In some examples, and as schematically illustrated in FIGS. 1-2, lever lug 170 may include one or more lever lug entry slots 176 configured to permit each pivot member 184 to selectively enter and exit pivot member receiver 128. In some examples, and as further schematically illustrated in FIGS. 1-3, slider body 110 includes lug aperture 132 defined by first clamp member 120 or second clamp member 140 such that lever lug 170 extends through the lug aperture.

When present, cam surface 192 generally is configured such that a distance between lever pivot axis 182 and the cam surface, as measured along a direction perpendicular to the lever pivot axis, varies over a length of the cam surface. In this manner, selectively varying the portion of cam surface 192 that is in contact with slider body 110 (such as by rotating actuation lever 180 relative to the slider body) may operate to selectively move first clamp member 120 relative to second clamp member 140 (and/or vice versa). As a more specific example, in which lever lug 170 is statically coupled to second clamp member 140 (as schematically illustrated in FIGS. 1-2), first clamp member 120 and second clamp member 140 may be biased away from each other such that the lever lug engages pivot member 184 to urge cam surface 192 into engagement with the first clamp member (as schematically illustrated in FIG. 1). In such an example, a separation between the first clamp member and the second clamp member (e.g., opening width 154) may be selectively controlled via rotation of actuation lever 180, such that rotating the actuation lever between the locking position and the adjusting position operates to transition slider assembly 100 between the locked configuration and the adjustment configuration. In some examples, and as schematically illustrated in FIGS. 1-2, cam surface 192 includes a locking surface 194 that engages and/or conforms to slider body 110 when slider assembly 100 is in the locked configuration, such as to retain the slider assembly in the locked configuration. For example, first clamp member 120 and second clamp member 140 may be biased away from one another such that engagement between locking surface 194 and slider body 110 and engagement between pivot member 184 and lever lug 170 collectively operate to restrict actuation lever 180 from pivoting relative to the slider body to transition the slider assembly away from the locked configuration. In some examples, and as schematically illustrated in FIGS. 1-2, locking surface 194 may be at least substantially flat and/or planar. In other examples, locking surface 194 may be contoured to at least substantially conform to a contour of slider body 110 when slider assembly 100 is in the locked configuration.

Figure 11:
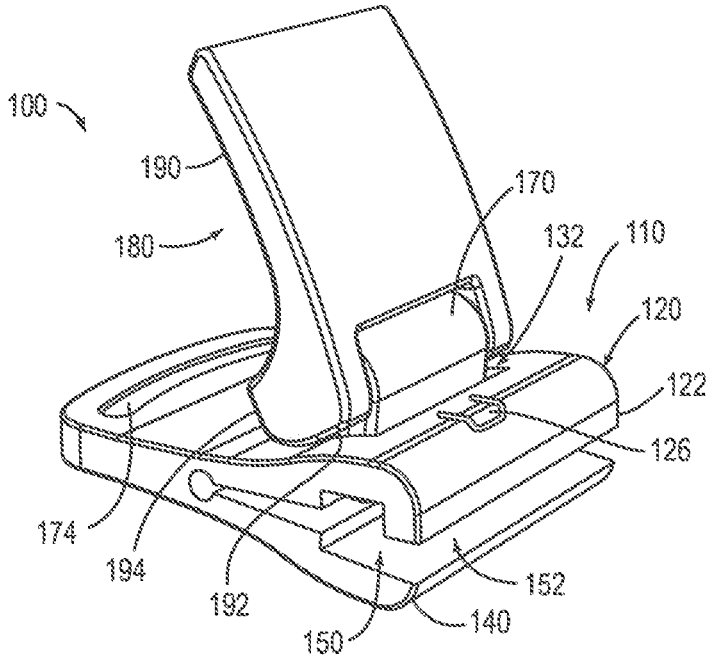
FIG. 11 is a top front side isometric view representing an example of a slider assembly in an adjustment configuration according to the present disclosure.
Figure 12:
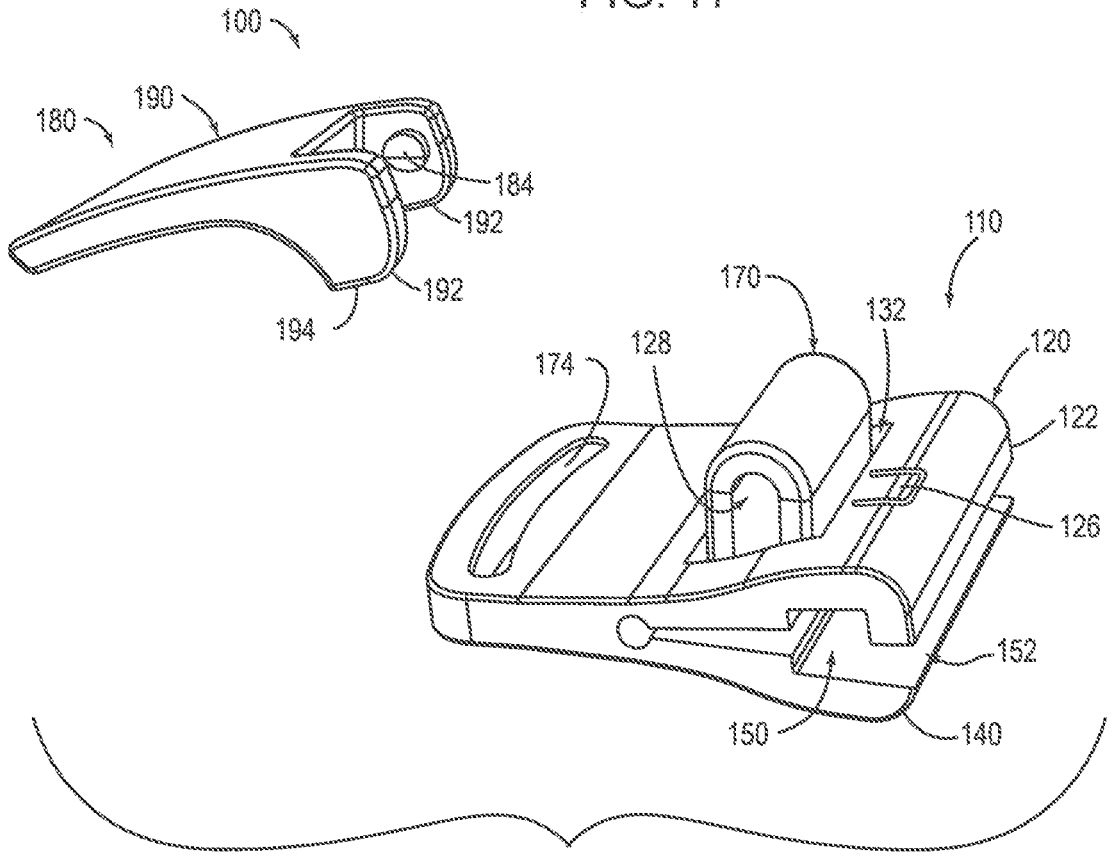
FIG. 12 is an exploded top front side isometric view representing the slider assembly of FIG. 11.

FIGS. 11-12 are less schematic illustrations of an example of slider assembly 100 in which slider body 110 includes lever lug 170 and lug aperture 132 and in which actuation lever 180 includes cam surface 192 for selectively urging first clamp member 120 and second clamp member 140 toward one another. Specifically, FIG. 11 illustrates slider assembly 100 in the adjustment configuration and with actuation lever 180 in the adjusting position. While the schematic representations of FIGS. 1-3 and the less schematic representations of 11-12 generally illustrate cam surface 192 as engaging first clamp member 120 and illustrate lever lug 170 as being fixedly coupled to second clamp member 140, this is not required of all examples of slider assembly 100 that include the cam surface and the lever lug. For example, it is additionally within the scope of the present disclosure that cam surface 192 may engage second clamp member 140 and/or that lever lug 170 may be fixedly coupled to first clamp member 120.

Slider assembly 100 and/or lock mechanism 160 may be configured to selectively and operatively engage slide track 10 in any appropriate manner, such as to prevent the slider assembly from moving relative to the slide track (or vice versa) when the slider assembly is in the locked configuration. For example, and as schematically illustrated in FIGS. 1-3, lock mechanism 160 may include one or more lock protrusions 162 that extend from one or both of first clamp member 120 and second clamp member 140 into track receiver 150. As schematically illustrated in FIGS. 1-2, each lock protrusion 162 may extend from and/or be formed on an inner surface 124 of first clamp member 120 and/or second clamp member 140. In such examples, and as schematically illustrated in FIG. 2, each lock protrusion 162 may be configured to engage slide track 10 and/or retention portion 20 when slider assembly 100 is in the locked configuration.

Lock protrusions 162 may be configured to operatively engage slide track 10 and/or retention portion 20 thereof in any appropriate manner. As an example, and as best schematically illustrated in FIG. 3, when retention portion 20 includes a plurality of discrete track elements 24, each lock protrusion 162 may be configured to extend at least partially between two adjacent track elements when slider assembly 100 is in the locked configuration. In this manner, lock mechanism 160 may be configured such that slide track 10 is prevented from moving relative to slider assembly 100 (or vice versa) along a direction parallel to receiver axis 102 when the slider assembly is in the locked configuration without damaging the slider assembly and/or the slide track. In an example in which slide track 10 includes fabric covering 26 at least substantially covering the plurality of track elements 24, the fabric covering may be sufficiently flexible and/or deformable that each lock protrusion 162 still extends between a pair of adjacent track elements, such as by urging the fabric covering to also extend between the pair of adjacent track elements.

In some examples, one or more lock protrusions 162 are configured to move and/or flex relative to at least a portion of slider body 110, such as first clamp member 120 or second clamp member 140 that supports and/or includes the lock protrusions. For example, and as schematically illustrated in FIGS. 1-3, first clamp member 120 and/or second clamp member 140 may include an indexing finger 126 that is configured to resiliently flex relative to a remainder of the first clamp member or the second clamp member that includes the indexing finger, and one or more lock protrusions 162 may be positioned and/or formed on the indexing finger. In such examples, indexing finger 126 may be biased toward track receiver 150 such that each lock protrusion 162 formed on the indexing finger also is biased toward the track receiver (and, thus, toward retention portion 20 when slider assembly 100 is operatively coupled to slide track 10). In this manner, indexing finger 126 may operate to maintain lock protrusion(s) 162 in engagement with retention portion 20 when slider assembly 100 is in the locked configuration.

Figure 13:
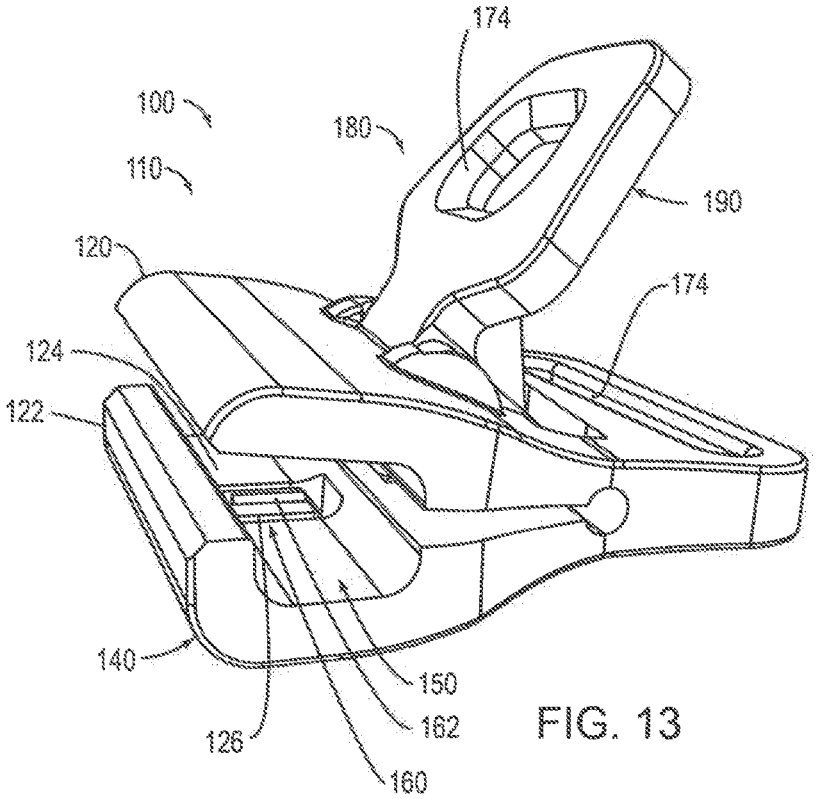
FIG. 13 is a top side isometric view representing an example of a slider assembly with a locking projection formed on a indexing finger according to the present disclosure.
Figure 14:
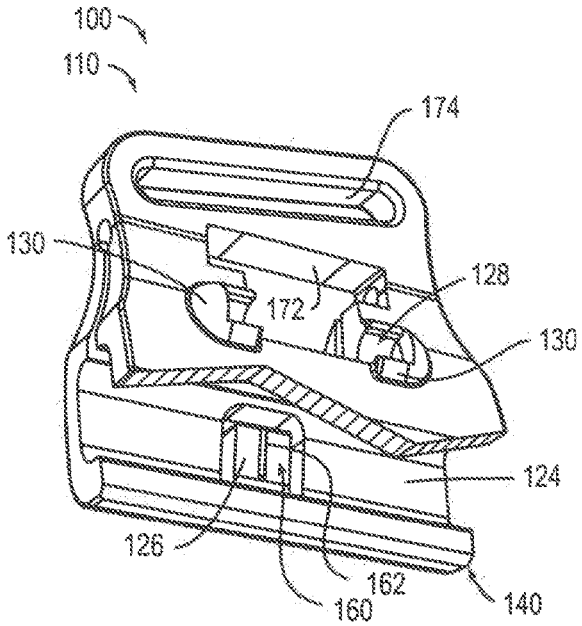
FIG. 14 is a top front side cutaway isometric view representing a slider body of the slider assembly of FIG. 13.
Figure 15:
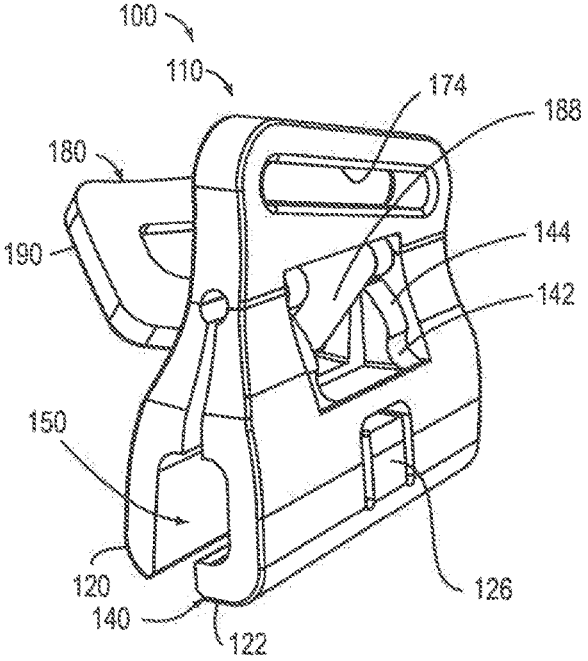
FIG. 15 is a bottom side isometric view representing the slider assembly of FIGS. 13-14.
Figure 16:
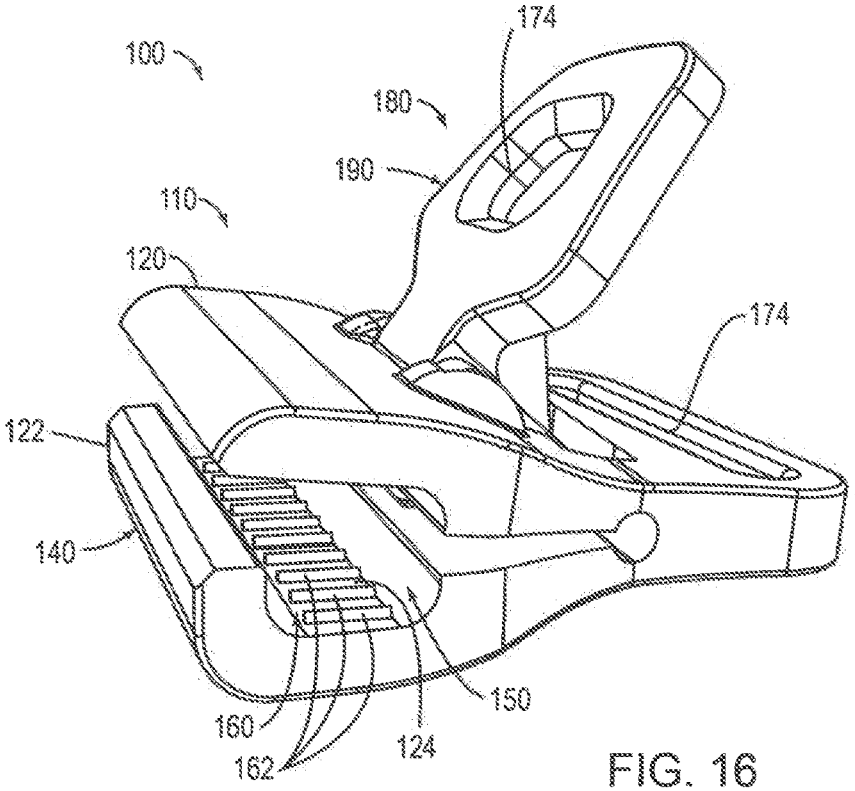
FIG. 16 is a top side isometric view representing an example of a slider assembly with a plurality of locking projections formed on a second clamp member according to the present disclosure.
Figure 17:
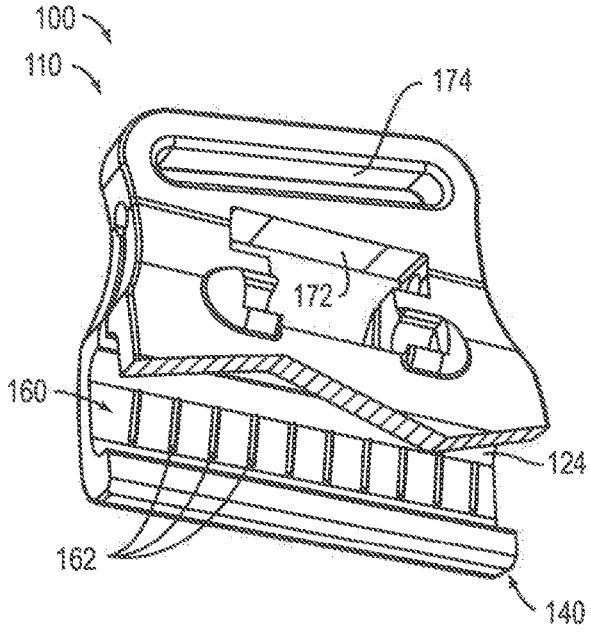
FIG. 17 is a top front side cutaway isometric view representing a slider body of the slider assembly of FIG. 16.

FIGS. 13-17 provide less schematic illustrations of examples of slider assembly 100 that include one or more lock protrusions 162. For example, FIGS. 13-15 illustrate an example of slider assembly 100 in which second clamp member 140 includes indexing finger 126 with a single lock protrusion 162 (shown in FIGS. 13-14), while FIGS. 16-17 illustrate an example of slider assembly 100 in which second clamp member 140 includes a plurality of lock protrusions 162 formed on inner surface 124 thereof.

In some examples, and as schematically illustrated in FIGS. 1-2, lock mechanism 160 may include and/or be a surface texturing 164 formed on inner surface 124 of at least a portion of first clamp member 120 and/or second clamp member 140. In such examples, surface texturing 164 may be configured to engage slide track 10 and/or retention portion 20 to restrict and/or prevent slider assembly 100 from translating relative to slide track 10 when the slider assembly is in the locked configuration. Surface texturing 164 may include and/or be any appropriate structure and/or material, such as a surface, a coating, and/or a material that is textured, dimensioned, constructed, knurled, and/or otherwise configured to frictional engagement with slide track 10. In such examples, surface texturing 164 may be a component of inner surface 124 (e.g., may be defined by the inner surface), and/or may be a separate component and/or layer that is applied and/or operatively coupled to the inner surface.

Figure 18:
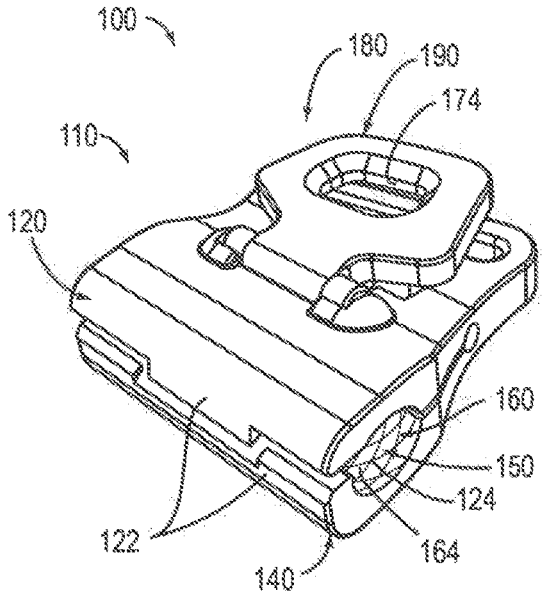
FIG. 18 is a top front side isometric view representing an example of a slider assembly with a lock mechanism that includes surface texturing according to the present disclosure.

FIG. 18 provides a less schematic illustration of an example of slider assembly that includes surface texturing 164 formed on inner surface 124 of at least second clamp member 140. FIG. 18 additionally illustrates an example of slider assembly 100 in which track receiver 150 has a cross-sectional shape that is substantially circular. In this manner, FIG. 18 may be described as illustrating an example of slider assembly 100 that is configured to be utilized with slide track 10 in the form of slide piping 60 with elongate rod 62 that is at least substantially circular in cross-section. FIG. 18 further illustrates an example of slider assembly 100 in which each of first clamp member 120 and second clamp member 140 may be described as including a respective lip 122, with the respective lips forming an interlocking configuration when the slider assembly is in the locked configuration.

In some examples, lock mechanism 160 and/or a portion thereof (such as first clamp member 120, second clamp member 140, one or more lock protrusions 162, and/or surface texturing 164) also may be configured to engage retention portion 20 when slider assembly 100 is in the adjustment configuration. For example, first clamp member 120, second clamp member 140, surface texturing 164, and/or lock protrusion(s) 162 may be configured to frictionally engage slide track 10 and/or retention portion 20 to partially restrict, but not prevent, motion of slider assembly 100 relative to the slide track when the slider assembly is in the adjustment configuration. In such examples, engagement between lock mechanism 160 and slide track 10 with slider assembly 100 in the adjustment configuration may facilitate at least partially and/or temporarily retaining the slider assembly in a position along the slide track while also permitting selective adjustment of the position of the slider assembly along the slide track. Such a configuration also may provide the user with a tactile and/or auditory feedback as the slider assembly slides along the slide track with the slider assembly in the adjustment configuration.

Figure 19:
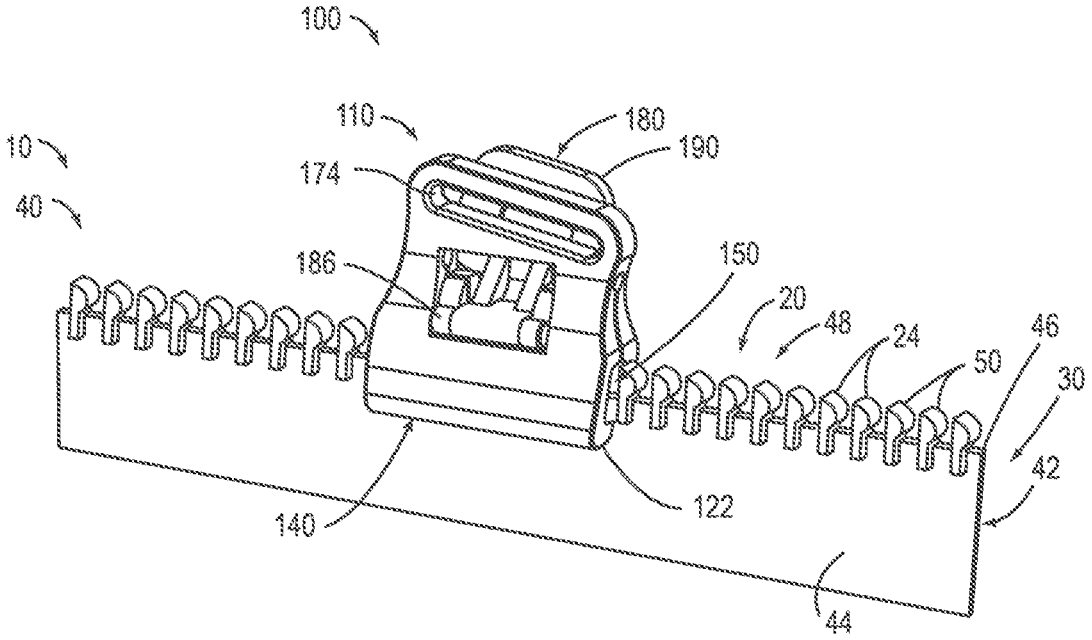
FIG. 19 is a bottom side isometric view representing an example of a slider assembly operatively coupled to a slide track that includes a zipper according to the present disclosure.
Figure 20:
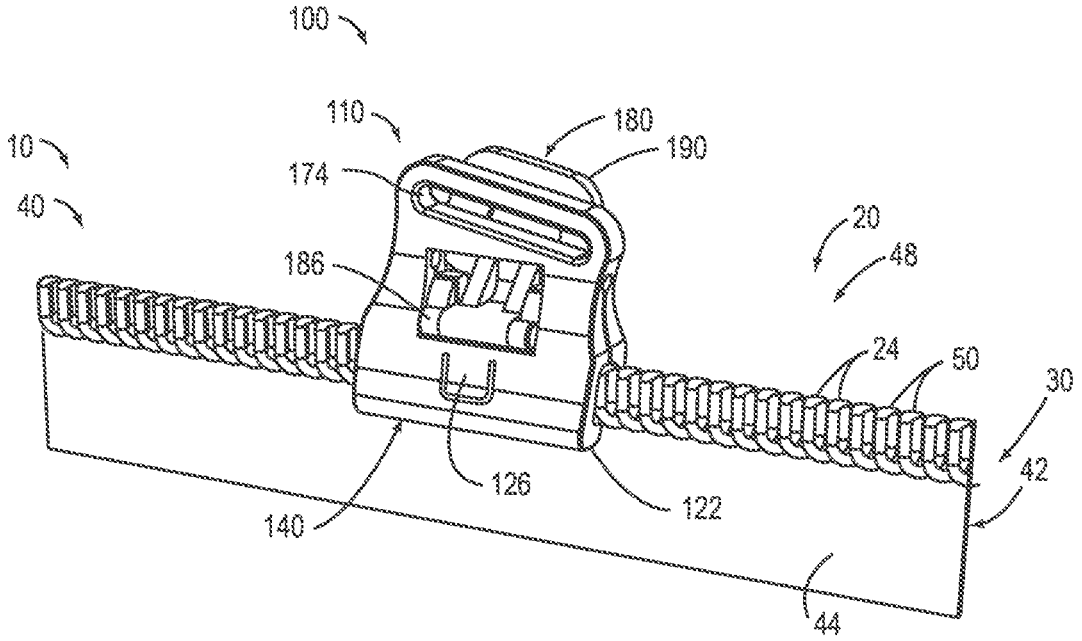
FIG. 20 is a bottom side isometric view representing the slider assembly of FIG. 19 operatively coupled to another slide track that includes a zipper according to the present disclosure.
Figure 21:
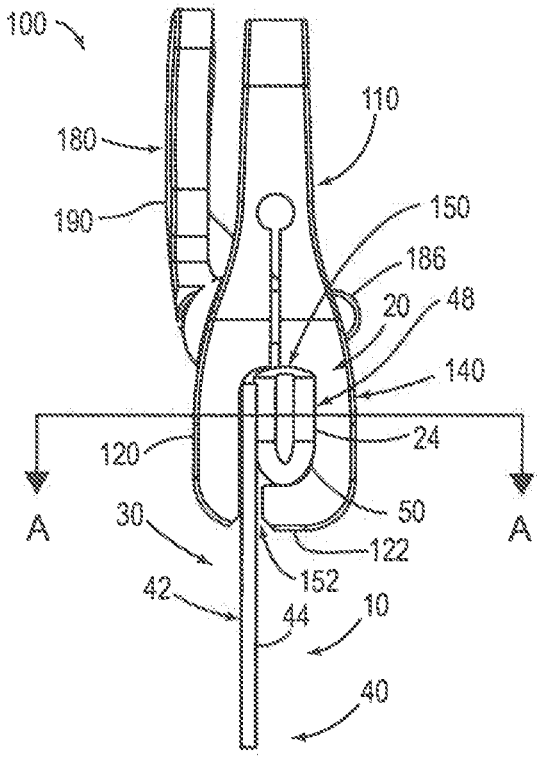
FIG. 21 is a side elevation view of the slider assembly operatively coupled to the slide track of FIG. 18.
Figure 22:
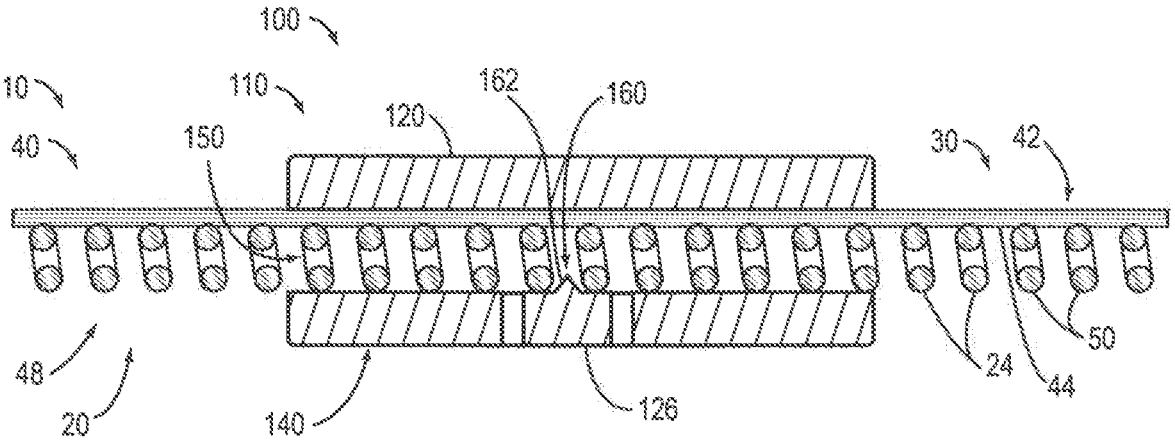
FIG. 22 is a cross-sectional rear elevation view taken along line A-A of FIG. 21.

FIGS. 19-22 provide less schematic illustrations of examples of slider assembly 100 operatively coupled to slide tracks 10 in the form of zipper tapes 40 and with the slider assembly in the locked configuration. Specifically, FIG. 19 illustrates an example of slider assembly 100 operatively coupled to an example of zipper tape 40 in which zipper elements 50 are operatively coupled to an edge 46 of zipper support 42, while FIGS. 20-22 illustrate an example of slider assembly 100 operatively coupled to an example of zipper tape 40 in which zipper elements 50 are operatively coupled to a side surface 44 of the zipper support.

In particular, FIGS. 21-22 best illustrate zipper elements 50 extending within track receiver 150. For example, FIG. 21 illustrates that, in the example of FIGS. 20-22, track receiver 150 is shaped to correspond to a shape of each zipper element 50. FIG. 21 also may be described as illustrating that, with slider assembly 100 in the locked configuration, zipper chain 48 is prevented from being removed from track receiver 150 via receiver opening 152. Additionally, and as shown in FIG. 21, pulling on zipper support 42 in an effort to urge zipper chain 48 out of track receiver 150 via receiver opening 152 would operate to exert a force upon lip 122 in a direction perpendicular to a direction of a force that could operate to move first clamp member 120 and second clamp member 140 away from one another. Stated differently, in the example of FIGS. 20-22, pulling on zipper support 42 in an effort to urge zipper chain 48 out of track receiver 150 via receiver opening 152 generally will not operate to urge first clamp member 120 and second clamp member 140 apart.

FIG. 22 represents a view taken along line A-A of FIG. 21. As best illustrated in FIG. 22, second clamp member 140 includes indexing finger 126 with lock protrusion 162 extending into track receiver 150. More specifically, FIG. 22 illustrates that, when slider assembly 100 is in the locked configuration, lock protrusion 162 extends between adjacent zipper elements 50 to restrict and/or prevent the slider assembly from translating along zipper tape 40.

Slider assembly 100 may be a component of and/or utilized in conjunction with any appropriate articles, such as an article of outdoor equipment. As examples, and as illustrated in FIGS. 23-28, an article of outdoor equipment 200 may include at least one slide track 10 and at least one instance of slider assembly 100 operatively coupled to a corresponding slide track. As more specific examples, and as described in more detail herein, FIGS. 23-26 illustrate examples in which the article of outdoor equipment 200 is a backpack 210, while FIG. 27 illustrates an example in which the article of outdoor equipment 200 is a tent 260. However, these examples are not exhaustive or limiting, and it is additionally within the scope of the present disclosure that slider assembly 100 may be a component of and/or utilized in conjunction with any other article of outdoor equipment 200, such as a sling pack or climbing harness, and/or with any other appropriate article or item that includes slide track 10.

Figure 23:
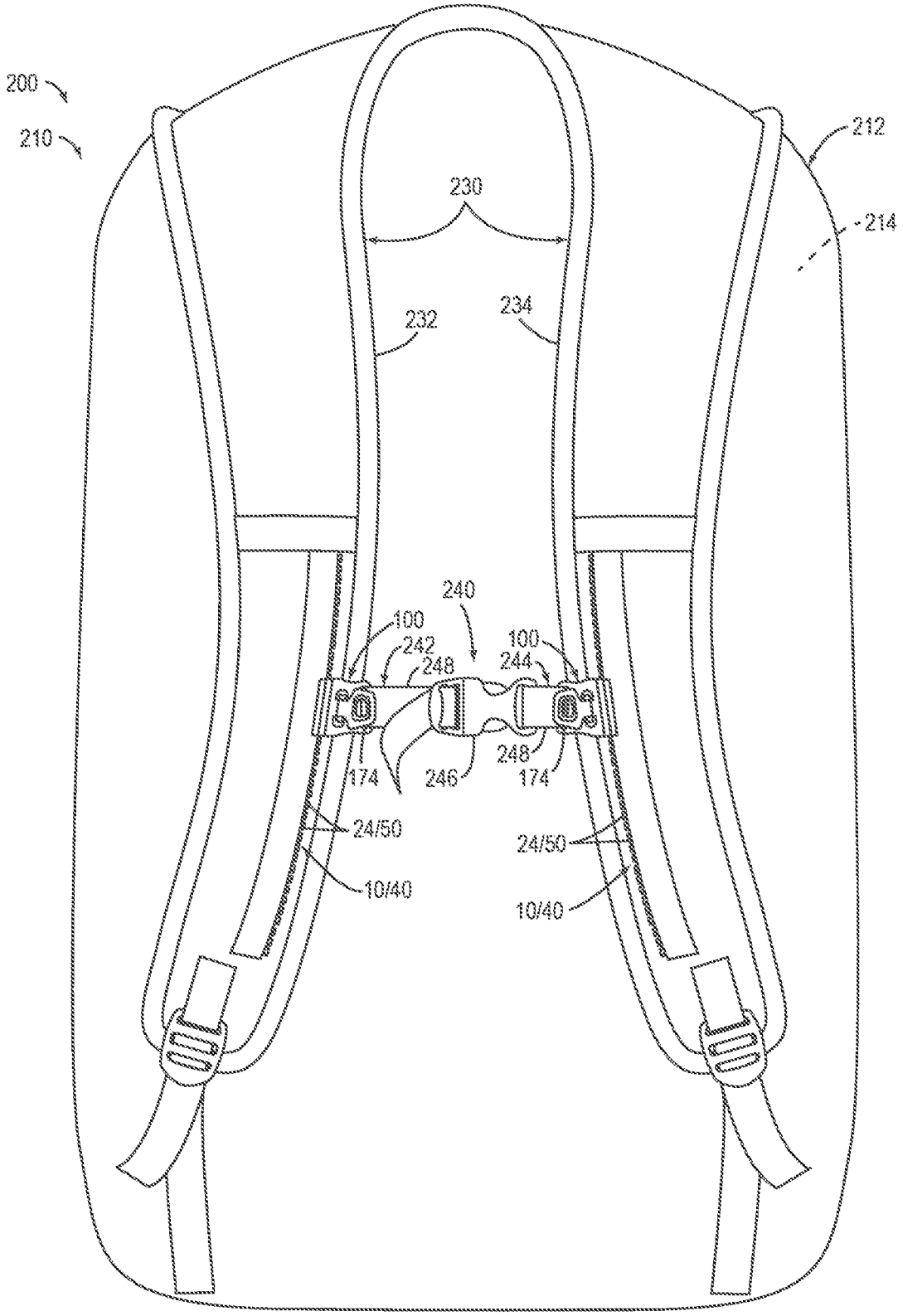
FIG. 23 is a front side elevation isometric view representing a portion of an example of a backpack that includes a sternum strap with two slider assemblies according to the present disclosure.

FIG. 23 illustrates an example of backpack 210 that includes slider assembly 100. As illustrated in FIG. 23, a backpack 210 that utilizes slider assembly 100 may include a pack body 212 that defines a pack volume 214, one or more shoulder straps 230 configured to at least partially support the pack body upon a user's back, and at least one instance of slider assembly 100. More specifically, and as further illustrated in FIG. 23, backpack 210 may include a first shoulder strap 232 and a second shoulder strap 234, as well as a sternum strap 240 configured to selectively and operatively interconnect the first shoulder strap and the second shoulder strap. In such examples, sternum strap 240 may include a first sternum strap portion 242 operatively coupled to first shoulder strap 232, a second sternum strap potion 244 operatively coupled to second shoulder strap 234, and a sternum strap buckle 246 configured to permit the first sternum strap portion and the second sternum strap portion to be selectively and repeatedly coupled to one another and uncoupled from one another. In such examples, and as illustrated in FIG. 23, each of first sternum strap portion 242 and second sternum strap portion 244 may include a portion of sternum strap buckle 246.

In some examples, it may be desirable to reposition sternum strap 240 (and/or a portion thereof) along a length of first shoulder strap 232 and/or of second shoulder strap 234. For example, and as further shown in FIG. 23, first sternum strap portion 242 may include a first instance of slider assembly 100 that is operatively coupled to a first instance of slide track 10 on first shoulder strap 232 to facilitate selectively positioning the first sternum strap portion along a length of the first shoulder strap. Similarly, second sternum strap portion 244 may include a second instance of slider assembly 100 that is operatively coupled to a second instance of slide track 10 on second shoulder strap 234 to facilitate selectively positioning the first sternum strap portion along a length of the second shoulder strap. Utilizing slider assemblies 100 in this manner thus may facilitate selectively positioning sternum strap 240 (and/or a portion thereof) along a length of shoulder strap 230 (such as first shoulder strap 232 and/or second shoulder strap 234) when the slider assembly is in the adjustment configuration, and selectively locking the sternum strap in position with respect to the shoulder strap(s) when the slider assembly is in the locking configuration.

In an example of backpack 210 that includes sternum strap 240 with sternum strap buckle 246, each portion of the sternum strap buckle may be operatively coupled to the respective slider assembly 100 in any appropriate manner. As an example, and as shown in FIG. 23, first sternum strap portion 242 and/or second sternum strap portion 244 may include a webbing 248 that operatively interconnects the respective portion of sternum strap buckle 246 and the respective slider assembly 100. For example, webbing 248 may be operatively coupled to attachment point 174 of the respective slider assembly 100. Additionally or alternatively, in some examples, first sternum strap portion 242 and/or second sternum strap portion 244 may include the respective portion of sternum strap buckle 246 integrally formed with the respective slider assembly 100.

Figure 24:
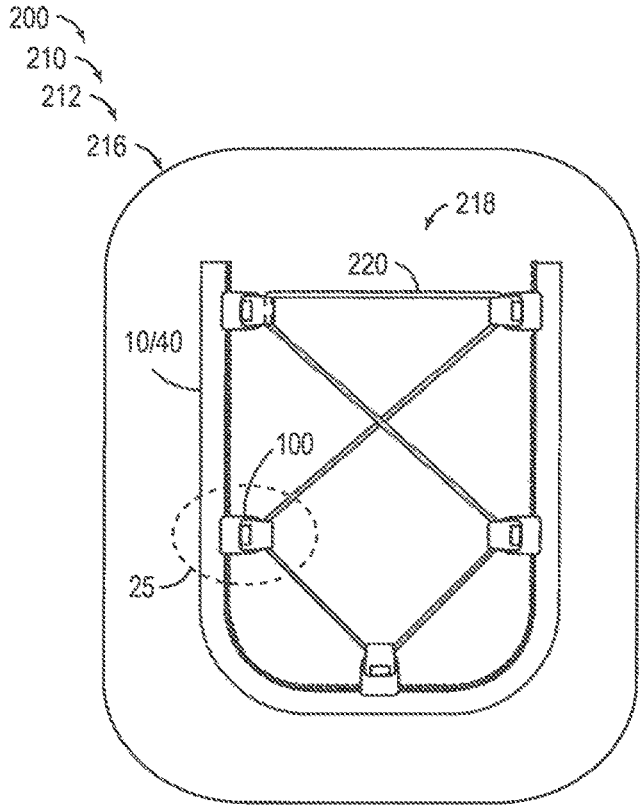
FIG. 24 is a rear side elevation isometric view representing a portion of another example of a backpack that includes an exterior storage assembly with six slider assemblies according to the present disclosure.
Figure 25:
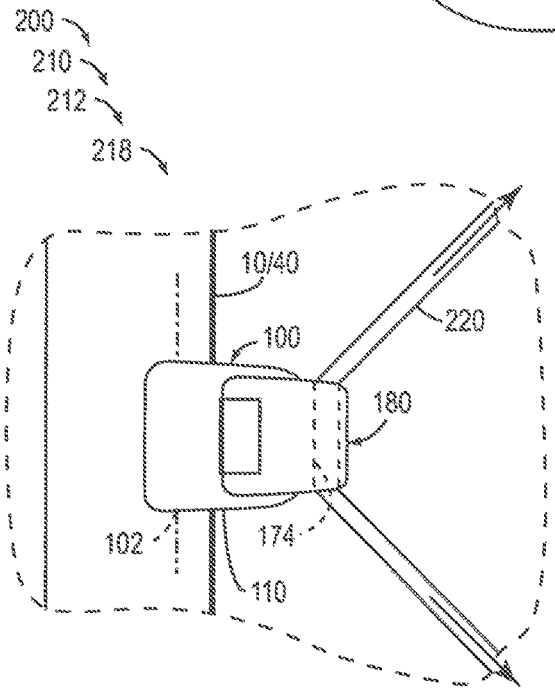
FIG. 25 is a rear side isometric view representing a magnified portion of FIG. 24.
Figure 26:
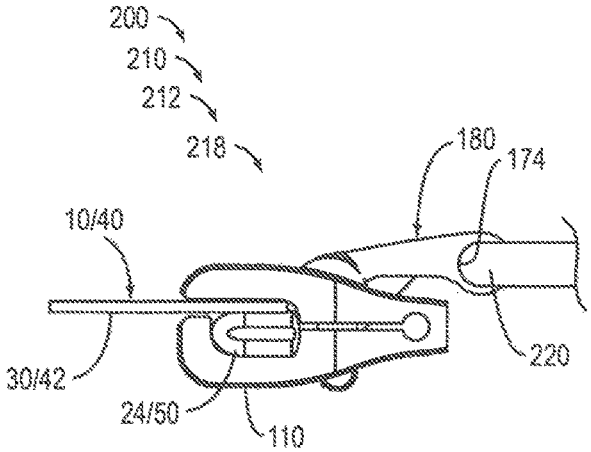
FIG. 26 is a bottom isometric view of the magnified portion of FIG. 24 that is illustrated in FIG. 25.
Figure 27:
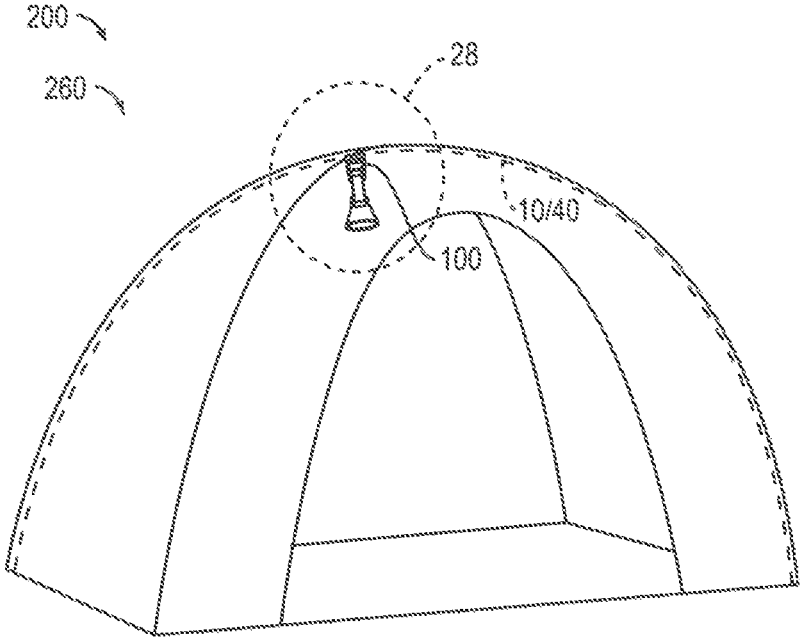
FIG. 27 is a front top side isometric view representing an example of a tent that includes a slider assembly according to the present disclosure.

FIGS. 24-26 illustrate another example of a portion of backpack 210 that utilizes slider assembly 100. Specifically, and as illustrated in FIG. 24, pack body 210 may have a pack exterior surface 216 and an exterior storage assembly 218 configured to store and/or restrain items against the pack exterior surface. For example, and as shown in FIG. 24, exterior storage assembly 218 may include one or more instances of slide track 10 (such as may include and/or be zipper tape 40), one or more instances of slider assembly 100 operatively coupled to the slide track(s), and one or more restraining cords 220 operatively coupled to and extending between the slider assemblies. In this manner, and as shown in FIG. 24, restraining cord(s) 220 may form a net or array that is sized, tensioned, and/or otherwise configured to selectively retain items against pack exterior surface 216. In such examples, each slider assembly 100 may be configured to selectively translate along slide track 10 to selectively reposition restraining cord(s) 220 relative to pack exterior surface 216 and/or to selectively adjust a tension of each restraining cord. Each restraining cord 220 may include and/or be any appropriate cord for restraining items against pack exterior surface 216, such as an elastic cord and/or a non-elastic cord.

In an example of backpack 210 that includes exterior storage assembly 218, each slider assembly 100 may be operatively coupled to a respective restraining cord 220 in any appropriate manner. For example, each restraining cord 220 may be operatively coupled to attachment point 174 of slider assembly 100.

FIGS. 25-26 more clearly illustrate a configuration of slider assembly 100 in the example of FIG. 24. Specifically, FIG. 25 is a magnified view of a portion of FIG. 24 circled in dashed lines, while FIG. 26 is an end-on (bottom) view of the portion illustrated in FIG. 25. In the example of FIGS. 24-26, and as best shown in FIGS. 25-26, each slider assembly 100 includes attachment point 174 in the form of an aperture that extends through actuation lever 180 in a direction parallel to receiver axis 102 (shown in FIG. 25). FIG. 25 additionally illustrates arrows overlaid on the portions of restraining cord 220 extending away from actuation lever 180 to illustrate a force of tension applied to the actuation lever by the restraining cord. In this manner, restraining cord 220 operates to bias actuation lever 180 toward the locked configuration, thereby further restricting each slider assembly 100 from transitioning from the locked configuration toward the adjustment configuration during operative use of exterior storage assembly 218.

Figure 28:
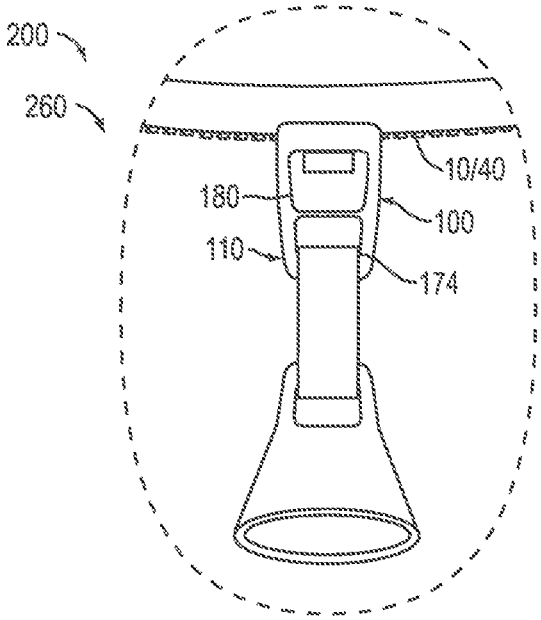
FIG. 28 is a front elevation isometric view representing a magnified portion of FIG. 27.

Turning now to FIGS. 27-28, FIG. 27 illustrates an example of outdoor equipment 200 in the form of tent 260 that includes slide track 10 (such as may include and/or be zipper tape 40) and slider assembly 100, while FIG. 28 is a magnified view of a portion of FIG. 27 circled in dashed lines. In the example of FIGS. 27-28, slide track 10 extends along an upper region of tent 260, and slider assembly 100 is operatively coupled to an accessory (such as a lamp) via attachment point 174. In this manner, utilizing tent 260 in conjunction with slider assembly 100 permits the accessory to be selectively positioned along slide track 10 when slider assembly 100 is in the adjustment configuration and permits the accessory to be selectively retained in position along the slide track when the slider assembly is in the locked configuration.

Examples of slider assemblies and/or outdoor equipment including the same according to the present disclosure are described in the following enumerated paragraphs:

A1. A slider assembly configured to be operatively and slidingly coupled to a slide track, the slider assembly comprising:

a slider body that includes a first clamp member and a second clamp member that collectively define at least a portion of a track receiver; and an actuation lever operatively coupled to the slider body;

wherein the track receiver receives a portion of the slide track when the slider assembly is operatively coupled to the slide track; wherein the slider assembly is configured to selectively translate along the slide track when the slider assembly is operatively coupled to the slide track; wherein the slider body further includes a lock mechanism configured to selectively prevent the slider assembly from translating relative to the slide track when the slider assembly is operatively coupled to the slide track; and wherein the actuation lever is configured to pivot about a lever pivot axis and relative to the slider body to selectively transition the slider assembly between an adjustment configuration, in which the slider assembly may be selectively and operatively translated along the slide track when the slider assembly is operatively coupled to the slide track, and a locked configuration, in which the lock mechanism prevents the slider assembly from translating relative to the slide track when the slider assembly is operatively coupled to the slide track.

A2. The slider assembly of paragraph A1, wherein the actuation lever is configured to pivot about the lever pivot axis and relative to the slider body to assume a position of a plurality of positions defined between and including an adjusting position and a locking position; wherein the slider assembly is in the adjustment configuration when the actuation lever is in the adjusting position; and wherein the slider assembly is in the locked configuration when the actuation lever is in the locking position.

A3. The slider assembly of any of paragraphs A1-A2, wherein the track receiver extends along a receiver axis, and wherein the slider assembly is configured to translate along the slide track in a direction parallel to the receiver axis when the slider assembly is in the adjustment configuration and when the slider assembly is operatively coupled to the slide track.

A4. The slider assembly of paragraph A3, wherein the lever pivot axis is at least substantially parallel to the receiver axis.

A5. The slider assembly of any of paragraphs A1-A4, wherein, when the slider assembly transitions from the adjustment configuration toward the locked configuration, one or both of the first clamp member and the second clamp member move toward one another.

A6. The slider assembly of any of paragraphs A1-A5, wherein the first clamp member and the second clamp member collectively define a receiver opening configured to permit access to the track receiver along a direction parallel to a lateral axis that extends perpendicular to a/the receiver axis.

A7. The slider assembly of paragraph A6, wherein the receiver opening extends adjacent to the track receiver.

A8. The slider assembly of any of paragraphs A1-A7, wherein one or both of the first clamp member and the second clamp member includes a lip that extends toward the other of the first clamp member and the second clamp member, and wherein the lip partially defines the track receiver.

A9. The slider assembly of paragraph A8, wherein the lip at least partially defines a/the receiver opening.

A10. The slider assembly of any of paragraphs A8-A9, wherein the lip extends at least substantially perpendicular to each of a/the receiver axis and a/the lateral axis.

A11. The slider assembly of any of paragraphs A8-A10, wherein the lip is configured to restrict the slide track from being removed from the track receiver along a direction parallel to a/the lateral axis when the slider assembly is operatively coupled to the slide track.

A12. The slider assembly of any of paragraphs A1-A11, wherein the track receiver has a cross-sectional shape, as viewed along a/the receiver axis, that is one or more of at least substantially polygonal, at least substantially rectangular, at least substantially circular, and non-circular.

A13. The slider assembly of any of paragraphs A1-A12, wherein the slider assembly is prevented from being removed from the slide track along a direction parallel to a/the lateral axis when the slider assembly is operatively coupled to the slide track and when the slider assembly is in either of the locked configuration and the adjustment configuration.

A14. The slider assembly of paragraph A13, wherein the slider assembly is configured to be operatively coupled to a slide track that includes:

a retention portion that extends within the track receiver when the slide assembly is operatively coupled to the slide track; and a connection portion that extends away from the retention portion and through a/the receiver opening when the slide assembly is operatively coupled to the slide track;

wherein the retention portion has a retention portion thickness, as measured along a direction perpendicular to each of a/the receiver axis and a/the lateral axis; wherein the receiver opening has an opening width, as measured along the direction perpendicular to each of the receiver axis and the lateral axis; and wherein the opening width is smaller than the retention portion thickness when the slider assembly is in either of the locked configuration or the adjustment configuration.

A15. The slider assembly of any of paragraphs A1-A14, wherein one or both of the slider body and the actuation lever is formed of one or more of a plastic, a thermoplastic, and a metal.

A16. The slider assembly of any of paragraphs A1-A15, wherein the first clamp member and the second clamp member are integrally formed with one another.

A17. The slider assembly of any of paragraphs A1-A16, wherein, when the slider assembly is in the locked configuration, the first clamp member and the second clamp member are biased away from one another.

A18. The slider assembly of any of paragraphs A1-A17, wherein one or both of the slider body and the actuation lever is formed via an injection molding process.

A19. The slider assembly of any of paragraphs A1-A18, wherein the actuation lever is configured to be selectively and repeatedly removed from and operatively coupled to the slider body without damage to the slider assembly.

A20. The slider assembly of any of paragraphs A1-A19, wherein the slider assembly further is configured to be selectively transitioned to a removal configuration in which a/the retention portion of the slide track may be selectively removed from the track receiver along a direction parallel to a/the lateral axis when the slider assembly is operatively coupled to the slide track.

A21. The slider assembly of paragraph A20, wherein a/the opening width is substantially equal to or greater than a/the retention portion thickness when the slider assembly is in the removal configuration.

A22. The slider assembly of any of paragraphs A20-A21, wherein the slider assembly is configured to be selectively transitioned to the removal configuration only when the actuation lever is selectively removed from the slider body.

A23. The slider assembly of any of paragraphs A20-A22, wherein the actuation lever is configured to pivot about the lever pivot axis and relative to the slider body to enable the slider assembly to transition to the removal configuration.

A24. The slider assembly of paragraph A23, wherein the actuation lever is configured to assume a/the plurality of positions including a removing position, and wherein the slider assembly is in the removal configuration when the actuation lever is in the removing position.

A25. The slider assembly of paragraph A24, wherein the slider assembly is configured such that the slider assembly may be transitioned to the removal configuration only subsequent to transitioning the actuation lever to the removing position.

A26. The slider assembly of any of paragraphs A24-A25, wherein the actuation lever is configured to transition between a/the locking position and the removing position via a/the adjusting position.

A27. The slider assembly of any of paragraphs A24-A25, wherein the actuation lever is configured to transition between a/the adjusting position and the removing position via a/the locking position.

A28. The slider assembly of any of paragraphs A1-A27, wherein the lock mechanism includes one or more lock protrusions that extend from one or both of the first clamp member and the second clamp member into the track receiver, and wherein each lock protrusion is configured to engage the slide track to prevent the slider assembly from translating relative to the slide track when the slider assembly is in the locked configuration and when the slider assembly is operatively coupled to the slide track.

A29. The slider assembly of paragraph A28, wherein each lock protrusion is formed on an inner surface of one or both of the first clamp member and the second clamp member.

A30. The slider assembly of any of paragraphs A28-A29, wherein a/the retention portion includes a plurality of discrete track elements that are distributed along a length of the retention portion, and wherein each lock protrusion is configured to extend at least partially between two adjacent track elements of the plurality of discrete track elements when the slider assembly is in the locked configuration and when the slider assembly is operatively coupled to the slide track.

A31. The slider assembly of any of paragraphs A28-A30, wherein one or both of the first clamp member and the second clamp member includes an indexing finger; wherein the indexing finger is configured to resiliently flex relative to a remainder of the first clamp member or the second clamp member that includes the indexing finger and wherein one or more of the lock protrusions are formed on an inner surface of the indexing finger.

A32. The slider assembly of any of paragraphs A1-A31, wherein one or more of (i) the track receiver and (ii) one or more of a/the lock protrusions are configured to frictionally engage the slide track to partially restrict motion of the slider assembly relative to the slide track while the slider assembly is translated along the slide track and when the slider assembly is in the adjustment configuration and is operatively coupled to the slide track.

A33. The slider assembly of any of paragraphs A1-A32, wherein the lock mechanism includes a surface texturing formed on an/the inner surface of one or both of the first clamp member and the second clamp member, and wherein the surface texturing is configured to engage the slide track to prevent the slider assembly from translating relative to the slide track when the slider assembly is in the locked configuration and when the slider assembly is operatively coupled to the slide track.

A34. The slider assembly of paragraph A33, wherein the surface texturing further is configured to engage the slide track to partially restrict the slider assembly from translating relative to the slide track while the slider assembly is translated along the slide track and when the slider assembly is in the adjustment configuration and is operatively coupled to the slide track.

A35. The slider assembly of any of paragraphs A1-A34, wherein the lock mechanism is spaced apart from the actuation lever when the slider assembly is in the locked configuration.

A36. The slider assembly of any of paragraphs A1-A35, wherein the actuation lever is spaced apart from the slide track when the slider assembly is in the locked configuration and is operatively coupled to the slide track.

A37. The slider assembly of any of paragraphs A1-A36, wherein the actuation lever includes an engagement element configured to be selectively engaged by a user to selectively pivot the actuation lever relative to the slider body.

A38. The slider assembly of paragraph A37, wherein the engagement element extends at least substantially parallel to the slider body when the slider assembly is in the locked configuration.

A39. The slider assembly of any of paragraphs A1-A38, wherein the actuation lever is configured to engage one or both of the first clamp member and the second clamp member to move the first clamp member and the second clamp member toward one another as the actuation lever pivots to transition the slider assembly from the adjustment configuration to the locked configuration.

A40. The slider assembly of any of paragraphs A1-A39, wherein the actuation lever extends at least partially through the slider body.

A41. The slider assembly of paragraph A40, wherein the actuation lever extends at least partially through each of the first clamp member and the second clamp member.

A42. The slider assembly of any of paragraphs A1-A41, wherein the slider body includes a pivot member receiver, and wherein the actuation lever includes at least one pivot member that is pivotally received within the pivot member receiver when the actuation lever is operatively coupled to the slider body.

A43. The slider assembly of paragraph A42, wherein each pivot member includes a unitary bar, optionally a substantially cylindrical bar.

A44. The slider assembly of any of paragraphs A42-A43, wherein each pivot member includes one of a plurality of spaced-part protrusions, optionally a plurality of spaced-apart cylindrical protrusions.

A45. The slider assembly of any of paragraphs A42-A44, wherein the pivot member receiver includes a pivot member retainer configured to retain the pivot member within the pivot member receiver.

A46. The slider assembly of paragraph A45, wherein the pivot member retainer is configured to permit the pivot member to be selectively removed from the pivot member receiver.

A47. The slider assembly of any of paragraphs A42-A46, wherein one of the first clamp member and the second clamp member includes the pivot member receiver; wherein the other of the first clamp member and the second clamp member includes a lever lock receiver; and wherein the actuation lever includes:

a lever lock that is selectively received within the lever lock receiver when the slider assembly is in the locked configuration; and a connector element that extends between the pivot member and the lever lock.

A48. The slider assembly of paragraph A47, wherein the lever lock includes a unitary bar, optionally a substantially cylindrical bar.

A49. The slider assembly of any of paragraphs A47-A48, wherein, when the pivot member is operatively received within the pivot member receiver, pivoting the actuation lever relative to the slider body to transition the slider assembly from the adjustment configuration to the locked configuration operates to move the lever lock into the lever lock receiver, and pivoting the actuation lever relative to the slider body to transition the slider assembly from the locked configuration to the adjustment configuration operates to move the lever lock out of the lever lock receiver.

A50. The slider assembly of any of paragraphs A47-A49, wherein the lever lock is restricted from exiting the lever lock receiver when the slider assembly is in the locked configuration.

A51. The slider assembly of paragraph A50, wherein the slider assembly is configured to transition from the locked configuration toward the adjustment configuration responsive to a/the user applying a torque to a/the engagement element that is at least equal to a threshold torque.

A52. The slider assembly of any of paragraphs A47-A51, wherein the one of the first clamp member and the second clamp member that includes the lever lock receiver further includes a lever lock ramped surface, and wherein the lever lock translates along the lever lock ramped surface as the slider assembly transitions between the adjustment configuration and the locked configuration.

A53. The slider assembly of paragraph A52, wherein, as the slider assembly is transitioned from the adjustment configuration toward the locked configuration, engagement between the lever lock and the lever lock ramped surface operates to urge the first clamp member and the second clamp member toward one another.

A54. The slider assembly of any of paragraphs A47-A53, wherein the connector element and a/the engagement element are statically coupled to one another.

A55. The slider assembly of any of paragraphs A47-A54, wherein the connector element and a/the engagement element extend in a fixed orientation relative to one another.

A56. The slider assembly of any of paragraphs A47-A55, wherein the connector element and a/the engagement element are nonparallel with one another.

A57. The slider assembly of paragraph A56, wherein the connector element and the engagement element extend at least substantially perpendicular to one another.

A58. The slider assembly of any of paragraphs A47-A57, wherein the connector element and a/the engagement element are integrally formed.

A59. The slider assembly of any of paragraphs A47-A58, wherein the slider body defines a lever lock aperture configured to permit one or both of the lever lock and the connector element to be selectively inserted into and removed from the slider body.

A60. The slider assembly of paragraph A59, wherein the lever lock aperture includes an elongate aperture that is elongate along a direction at least substantially parallel to the lever pivot axis when the actuation lever is operatively coupled to the slider body.

A61. The slider assembly of any of paragraphs A59-A60, wherein the lever lock aperture includes an elongate aperture that is elongate along a direction at least substantially parallel to a/the lateral axis.

A62. The slider assembly of any of paragraphs A59-A61, wherein the slider assembly is configured to be assembled by inserting the lever lock through the lever lock aperture and subsequently receiving a/the pivot member within a/the pivot member receiver.

A63. The slider assembly of paragraph A62, wherein the slider assembly is configured to be assembled by sequentially:

(i) inserting the lever lock through the lever lock aperture;

(ii) rotating the lever lock relative to the slider body; and (iii) receiving the pivot member within the pivot member receiver.

A64. The slider assembly of any of paragraphs A1-A63, wherein the slider body includes a lever lug that includes a/the pivot member receiver, wherein the lever lug is statically coupled to one of the first clamp member and the second clamp member, and wherein the other of the first clamp member and the second clamp member is configured to move relative to the lever lug as the slider assembly transitions between the adjustment configuration and the locked configuration.

A65. The slider assembly of paragraph A64, wherein the lever lug includes one or more lever lug entry slots configured to permit each of a/the at least one pivot member to selectively enter and exit the pivot member receiver.

A66. The slider assembly of any of paragraphs A64-A65, wherein the other of the first clamp member and the second clamp member defines a lug aperture, and wherein the lever lug extends through the lug aperture.

A67. The slider assembly of any of paragraphs A64-A66, wherein the actuation lever includes a cam surface that is configured to urge the first clamp member and the second clamp member toward one another as the actuation lever is pivoted relative to the slider body to transition the slider assembly from the adjustment configuration toward the locked configuration.

A68. The slider assembly of paragraph A67, wherein the cam surface is configured such that a distance between the lever pivot axis and the cam surface, as measured along a direction perpendicular to the lever pivot axis, varies over a length of the cam surface.

A69. The slider assembly of any of paragraphs A67-A68, wherein the cam surface includes a locking surface that engages the slider body when the slider assembly is in the locked configuration, and wherein, when the slider assembly is in the locked configuration, the first clamp member and the second clamp member are biased away from one another such that engagement between the locking surface and the slider body restricts the actuation lever from pivoting relative to the slider body to transition the slider assembly away from the locked configuration.

A70. The slider assembly of paragraph A69, wherein the locking surface is at least substantially flat and/or planar.

A71. The slider assembly of paragraph A69, wherein the locking surface is contoured to at least substantially conform to a contour of the slider body when the slider assembly is in the locked configuration.

A72. The slider assembly of any of paragraphs A1-A71, wherein one or both of the slider body and the actuation lever includes an attachment point configured to enable the slider assembly to be operatively attached to an accessory.

A73. The slider assembly of paragraph A72, wherein the attachment point includes one or more of a hole, a slot, an aperture, a channel, a groove, a buckle, a ladder-lock buckle, and a component of a side-release buckle.

A74. The slider assembly of any of paragraphs A72-A73, wherein the accessory includes one or more of a strap, a webbing, a cord, an elastic cord, a non-elastic cord, a buckle, and a component of a side-release buckle.

A75. The slider assembly of any of paragraphs A1-A74, wherein the slider assembly has a slider assembly length, as measured along a direction parallel to a/the lateral axis, that is one or more of at least 10 millimeters (mm), at least 15 mm, at least 20 mm, at least 25 mm, at least 30 mm, at least 40 mm, at most 50 mm, at most 35 mm, at most 27 mm, at most 22 mm, at most 17 mm, and at most 12 mm.

A76. The slider assembly of any of paragraphs A1-A75, wherein the slider assembly has a slider assembly width, as measured along a direction parallel to a/the receiver axis, that is one or more of at least 10 mm, at least 15 mm, at least 20 mm, at least 25 mm, at least 30 mm, at least 40 mm, at most 50 mm, at most 35 mm, at most 27 mm, at most 22 mm, at most 17 mm, and at most 12 mm.

A77. The slider assembly of any of paragraphs A1-A76, wherein the slider assembly has a slider assembly depth, as measured along a direction perpendicular to each of a/the lateral axis and a/the receiver axis when the slider assembly is in the locked configuration, that is one or more of at least 5 mm, at least 10 mm, at least 15 mm, at least 20 mm, at most 25 mm, at most 17 mm, at most 12 mm, and at most 7 mm.

A78. The slider assembly of any of paragraphs A1-A77 in combination with the slide track.

A79. The slider assembly of paragraph A78, wherein the slide track further includes a fabric covering that at least substantially covers a/the retention portion, and wherein the lock mechanism is configured to engage the fabric covering when the slider assembly is in one or both of the locked configuration and the adjustment configuration.

A80. The slider assembly of any of paragraphs A78-A79, wherein the slide track includes a zipper tape, and wherein a/the retention portion includes a zipper chain that is defined by a plurality of zipper elements.

A81. The slider assembly of paragraph A80, wherein a/the connection portion includes a zipper support of the zipper tape, wherein each of the plurality of zipper elements is operatively coupled to the zipper support.

A82. The slider assembly of paragraph A81, wherein the plurality of zipper elements are operatively coupled to an edge of the zipper support.

A83. The slider assembly of paragraph A81, wherein the plurality of zipper elements are operatively coupled to a side surface of the zipper support.

A84. The slider assembly of any of paragraphs A78-A83, wherein the slide track includes a slide piping, and wherein a/the retention portion includes an elongate rod.

A85. The slider assembly of any of paragraphs A78-A84, wherein a/the retention portion has a retention portion length, as measured along a direction parallel to a/the lateral axis when the slider assembly is operatively coupled to the slide track, that is one or more of at least 2 mm, at least 4 mm, at least 6 mm, at least 8 mm, at least 10 mm, at most 15 mm, at most 9 mm, at most 7 mm, at most 5 mm, and at most 3 mm.

A86. The slider assembly of any of paragraphs A78-A85, wherein a/the retention portion is formed via one or both of an extrusion process and an injection molding process.

A87. The slider assembly of any of paragraphs A78-A86, wherein a/the retention portion has a cross-sectional shape, as viewed along a/the receiver axis, that corresponds to and/or matches a/the cross-sectional shape of the track receiver.

B1. An article of outdoor equipment, comprising:

a slide track; and at least one instance of the slider assembly of any of paragraphs A1-A87 operatively coupled to the slide track;

wherein the article of outdoor equipment includes one or more of a sling pack, a backpack, a tent, and a climbing harness.

B2. The article of outdoor equipment of paragraph B1, wherein the article of outdoor equipment is the backpack, and wherein the backpack further includes:

a pack body that defines a pack volume;

one or more shoulder straps configured to at least partially support the pack body upon a user's back; and at least one instance of the slider assembly of any of paragraphs A1-A87.

B3. The article of outdoor equipment of paragraph B2, wherein the one or more shoulder straps includes a first shoulder strap and a second shoulder strap, wherein the backpack further includes a sternum strap with a first sternum strap portion operatively coupled to the first shoulder strap and a second sternum strap portion operatively coupled to the second shoulder strap; and wherein one or both of:

(i) the first sternum strap portion includes a first instance of the slider assembly, the first shoulder strap includes a first instance of the slide track, and the first instance of the slider assembly is configured to enable the first sternum strap portion to selectively translate along a length of the first shoulder strap; and (ii) the second sternum strap portion includes a second instance of the slider assembly, the second shoulder strap includes a second instance of the slide track, and the second instance of the slider assembly is configured to enable the second sternum strap portion to selectively translate along a length of the second shoulder strap.

B4. The article of outdoor equipment of paragraph B3, wherein each of the first sternum strap portion and the second sternum strap portion includes a portion of a sternum strap buckle configured to permit the first sternum strap portion and the second sternum strap portion to be selectively and repeatedly coupled to one another and uncoupled from one another.

B5. The article of outdoor equipment of paragraph B4, wherein one or both of the first sternum strap portion and the second sternum strap portion includes a webbing that operatively interconnects the respective portion of the sternum strap buckle and the respective instance of the slider assembly.

B6. The article of outdoor equipment of paragraph B5, wherein the webbing is operatively coupled to a/the attachment point of the respective instance of the slider assembly.

B7. The article of outdoor equipment of any of paragraphs B4-B6, wherein one or both of the first sternum strap portion and the second sternum strap portion includes the respective portion of the sternum strap buckle integrally formed with the respective instance of the slider assembly.

B8. The article of outdoor equipment of any of paragraphs B2-B7, wherein the pack body has a pack exterior surface and an exterior storage assembly configured to store items against the pack exterior surface, wherein the exterior storage assembly includes:

one or more instances of the slide track;

one or more instances of the slider assembly operatively coupled to the one or more instances of the slide track; and one or more restraining cords operatively coupled to and extending between the one or more instances of the slider assembly;

wherein the one or more restraining cords collectively are configured to selectively retain the items between the one or more restraining cords and the pack exterior surface; and wherein each slider assembly is configured to selectively translate along the respective slide track to one or both of:

(i) selectively reposition the one or more restraining cords relative to the pack exterior surface; and (ii) selectively adjust a tension of each of the one or more restraining cords.

B9. The article of outdoor equipment of paragraph B8, wherein each restraining cord is operatively coupled to a/the attachment point of the respective instance of the slider assembly.

B10. The article of outdoor equipment of any of paragraphs B8-B9, wherein each restraining cord includes one or more of an elastic cord or a non-elastic cord.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

In the event that any patents, patent applications, or other references are incorporated by reference herein and (1)

define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A slider assembly configured to be operatively and slidingly coupled to a slide track, the slider assembly comprising:

a slider body that includes a first clamp member and a second clamp member that collectively define at least a portion of a track receiver; and an actuation lever operatively coupled to the slider body;

wherein the track receiver receives a portion of the slide track when the slider assembly is operatively coupled to the slide track; wherein the slider assembly is configured to selectively translate along the slide track when the slider assembly is operatively coupled to the slide track; wherein the slider body further includes a lock mechanism configured to selectively prevent the slider assembly from translating relative to the slide track when the slider assembly is operatively coupled to the slide track; wherein the actuation lever is configured to pivot about a lever pivot axis and relative to the slider body to selectively transition the slider assembly between an adjustment configuration, in which the slider assembly may be selectively and operatively translated along the slide track when the slider assembly is operatively coupled to the slide track, and a locked configuration, in which the lock mechanism prevents the slider assembly from translating relative to the slide track when the slider assembly is operatively coupled to the slide track; wherein, when the slider assembly transitions from the adjustment configuration toward the locked configuration, one or both of the first clamp member and the second clamp member move toward one another; wherein the lock mechanism includes one or more lock protrusions that extend from one or both of the first clamp member and the second clamp member into the track receiver; wherein each lock protrusion is formed on an inner surface of one or both of the first clamp member and the second clamp member; and wherein each lock protrusion is configured to engage the slide track to prevent the slider assembly from translating relative to the slide track when the slider assembly is in the locked configuration and when the slider assembly is operatively coupled to the slide track.

2. The slider assembly of claim 1, wherein the track receiver extends along a receiver axis; wherein the slider assembly is configured to translate along the slide track in a direction parallel to the receiver axis when the slider assembly is in the adjustment configuration and when the slider assembly is operatively coupled to the slide track; and wherein the first clamp member and the second clamp member collectively define a receiver opening configured to permit access to the track receiver along a direction parallel to a lateral axis that extends perpendicular to the receiver axis.

3. The slider assembly of claim 2, wherein the slider assembly is prevented from being removed from the slide track along a direction parallel to the lateral axis when the slider assembly is operatively coupled to the slide track and when the slider assembly is in either of the locked configuration and the adjustment configuration.

4. The slider assembly of claim 2, wherein one or both of the first clamp member and the second clamp member includes a lip that extends toward the other of the first clamp member and the second clamp member; wherein the lip partially defines the track receiver; and wherein the lip is configured to restrict the slide track from being removed from the track receiver along a direction parallel to the lateral axis when the slider assembly is operatively coupled to the slide track.

5. The slider assembly of claim 1, wherein the slider assembly is configured to be operatively coupled to a slide track that includes a retention portion that extends within the track receiver when the slide assembly is operatively coupled to the slide track; wherein the retention portion includes a plurality of discrete track elements that are distributed along a length of the retention portion; and wherein each lock protrusion is configured to extend at least partially between two adjacent track elements of the plurality of discrete track elements when the slider assembly is in the locked configuration and when the slider assembly is operatively coupled to the slide track.

6. The slider assembly of claim 1, wherein the lock mechanism includes a surface texturing formed on an inner surface of one or both of the first clamp member and the second clamp member, and wherein the surface texturing is configured to engage the slide track to prevent the slider assembly from translating relative to the slide track when the slider assembly is in the locked configuration and when the slider assembly is operatively coupled to the slide track.

7. The slider assembly of claim 1, wherein one or both of the first clamp member and the second clasp member includes an indexing finger; wherein the indexing finger is configured to resiliently flex relative to a remainder of the first clamp member or the second clamp member that includes the indexing finger; and wherein one or more of the lock protrusions are formed on an inner surface of the indexing finger.

8. The slider assembly of claim 1, wherein at least a portion of the lock mechanism is configured to frictionally engage the slide track to partially restrict motion of the slider assembly relative to the slide track while the slider assembly is translated along the slide track and when the slider assembly is in the adjustment configuration and is operatively coupled to the slide track.

9. The slider assembly of claim 1, wherein the actuation lever is configured to be selectively and repeatedly removed from and operatively coupled to the slider body without damage to the slider assembly.

10. The slider assembly of claim 1, wherein one or both of the slider body and the actuation lever includes an attachment point configured to enable the slider assembly to be operatively attached to an accessory, and wherein the attachment point includes one or more of a hole, a slot, an aperture, a channel, a groove, a buckle, a ladder-lock buckle, and a component of a side-release buckle.

11. An article of outdoor equipment, comprising:

the slider assembly and the slide track of claim 1;

wherein the slider assembly is operatively coupled to the slide track; and wherein the article of outdoor equipment includes one or more of a sling pack, a backpack, a tent, and a climbing harness.

12. A slider assembly configured to be operatively and slidingly coupled to a slide track, the slider assembly comprising:

a slider body that includes a first clamp member and a second clamp member that collectively define at least a portion of a track receiver; and an actuation lever operatively coupled to the slider body;

wherein the track receiver receives a portion of the slide track when the slider assembly is operatively coupled to the slide track; wherein the slider assembly is configured to selectively translate along the slide track when the slider assembly is operatively coupled to the slide track; wherein the slider body further includes a lock mechanism configured to selectively prevent the slider assembly from translating relative to the slide track when the slider assembly is operatively coupled to the slide track; wherein the actuation lever is configured to pivot about a lever pivot axis and relative to the slider body to selectively transition the slider assembly between an adjustment configuration, in which the slider assembly may be selectively and operatively translated along the slide track when the slider assembly is operatively coupled to the slide track, and a locked configuration, in which the lock mechanism prevents the slider assembly from translating relative to the slide track when the slider assembly is operatively coupled to the slide track; wherein, when the slider assembly transitions from the adjustment configuration toward the locked configuration, one or both of the first clamp member and the second clamp member move toward one another; wherein the slider body includes a pivot member receiver; wherein the actuation lever includes at least one pivot member that is pivotally received within the pivot member receiver when the actuation lever is operatively coupled to the slider body; wherein one of the first clamp member and the second clamp member includes the pivot member receiver; wherein the other of the first clamp member and the second clamp member includes a lever lock receiver; and wherein the actuation lever includes:

a lever lock that is selectively received within the lever lock receiver when the slider assembly is in the locked configuration; and a connector element that extends between the pivot member and the lever lock.

13. The slider assembly of claim 12, wherein, when the pivot member is operatively received within the pivot member receiver, pivoting the actuation lever relative to the slider body to transition the slider assembly from the adjustment configuration to the locked configuration operates to move the lever lock into the lever lock receiver, and pivoting the actuation lever relative to the slider body to transition the slider assembly from the locked configuration to the adjustment configuration operates to move the lever lock out of the lever lock receiver.

14. The slider assembly of claim 12, wherein the one of the first clamp member and the second clamp member that includes the lever lock receiver further includes a lever lock ramped surface; wherein the lever lock translates along the lever lock ramped surface as the slider assembly transitions between the adjustment configuration and the locked configuration; and wherein, as the slider assembly is transitioned from the adjustment configuration toward the locked configuration, engagement between the lever lock and the lever lock ramped surface operates to urge the first clamp member and the second clamp member toward one another.

15. The slider assembly of claim 12, wherein the slider body includes a lever lug that includes the pivot member receiver; wherein the lever lug is statically coupled to one of the first clamp member and the second clamp member; wherein the other of the first clamp member and the second clamp member is configured to move relative to the lever lug as the slider assembly transitions between the adjustment configuration and the locked configuration; and wherein the actuation lever includes a cam surface that is configured to urge the first clamp member and the second clamp member toward one another as the actuation lever is pivoted relative to the slider body to transition the slider assembly from the adjustment configuration toward the locked configuration.

16. The slider assembly of claim 12, wherein the track receiver extends along a receiver axis; wherein the slider assembly is configured to translate along the slide track in a direction parallel to the receiver axis when the slider assembly is in the adjustment configuration and when the slider assembly is operatively coupled to the slide track; wherein the first clamp member and the second clamp member collectively define a receiver opening configured to permit access to the track receiver along a direction parallel to a lateral axis that extends perpendicular to the receiver axis; and wherein the slider assembly is prevented from being removed from the slide track along a direction parallel to the lateral axis when the slider assembly is operatively coupled to the slide track and when the slider assembly is in either of the locked configuration and the adjustment configuration.

17. An article of outdoor equipment, comprising:

the slider assembly and the slide track of claim 12;

wherein the slider assembly is operatively coupled to the slide track; and wherein the article of outdoor equipment includes one or more of a sling pack, a backpack, a tent, and a climbing harness.

18. A slide track assembly, comprising:

a slide track; and a slider assembly configured to be operatively and slidingly coupled to the slide track;

wherein the slider assembly comprises:

a slider body that includes a first clamp member and a second clamp member that collectively define at least a portion of a track receiver; and an actuation lever operatively coupled to the slider body; wherein the track receiver receives a portion of the slide track when the slider assembly is operatively coupled to the slide track; wherein the slider assembly is configured to selectively translate along the slide track when the slider assembly is operatively coupled to the slide track; wherein the slider body further includes a lock mechanism configured to selectively prevent the slider assembly from translating relative to the slide track when the slider assembly is operatively coupled to the slide track; wherein the actuation lever is configured to pivot about a lever pivot axis and relative to the slider body to selectively transition the slider assembly between an adjustment configuration, in which the slider assembly may be selectively and operatively translated along the slide track when the slider assembly is operatively coupled to the slide track, and a locked configuration, in which the lock mechanism prevents the slider assembly from translating relative to the slide track when the slider assembly is operatively coupled to the slide track; wherein, when the slider assembly transitions from the adjustment configuration toward the locked configuration, one or both of the first clamp member and the second clamp member move toward one another; wherein the slide track includes a zipper tape that includes a zipper chain that is defined by a plurality of zipper elements; and wherein the zipper chain extends within the track receiver when the slide assembly is operatively coupled to the zipper tape.

19. The slider assembly of claim 18, wherein the lock mechanism includes one or more lock protrusions that extend from one or both of the first clamp member and the second clamp member into the track receiver, and wherein each lock protrusion is configured to extend at least partially between two adjacent zipper elements of the plurality of zipper elements when the slider assembly is in the locked configuration and when the slider assembly is operatively coupled to the slide track.

20. An article of outdoor equipment, comprising:

the slide track assembly of claim 18;

wherein the slider assembly is operatively coupled to the slide track; and wherein the article of outdoor equipment includes one or more of a sling pack, a backpack, a tent, and a climbing harness.

* * * * *